US009348276B2

(12) United States Patent
Nakano

(10) Patent No.: US 9,348,276 B2
(45) Date of Patent: May 24, 2016

(54) FIXING DEVICE AND IMAGE FORMING APPARATUS

(71) Applicant: KONICA MINOLTA, INC., Chiyoda-ku, Tokyo (JP)

(72) Inventor: Motoki Nakano, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/704,284

(22) Filed: May 5, 2015

(65) Prior Publication Data

US 2015/0331369 A1 Nov. 19, 2015

(30) Foreign Application Priority Data

May 16, 2014 (JP) ..... 2014-102549

(51) Int. Cl.
*G03G 15/20* (2006.01)

(52) U.S. Cl.
CPC ..... *G03G 15/2039* (2013.01)

(58) Field of Classification Search
CPC ..... G03G 15/2053; G03G 2215/2035; G03G 15/2039; G03G 15/2017; G03G 15/0189; G03G 15/2042; G03G 15/2064; G03G 15/2078; G03G 15/5029; G03G 15/5058; G03G 2215/0158; G03G 2215/2019; G03G 15/2032
See application file for complete search history.

(56) References Cited

U.S. PATENT DOCUMENTS

2009/0092425 A1* 4/2009 Hayashi ..... G03G 15/206 399/329
2013/0209125 A1 8/2013 Uchitani et al.
2015/0104230 A1 4/2015 Uchitani et al.

FOREIGN PATENT DOCUMENTS

JP 2013057896 A 3/2013
JP 2013164438 A 8/2013

* cited by examiner

*Primary Examiner* — Roy Y Yi
(74) *Attorney, Agent, or Firm* — Holtz, Holtz & Volek PC

(57) ABSTRACT

A fixing device includes a pressurizer constituted of a rotating body, and a heater including a heat source, a fixing belt heated by the heat source, and a pressing portion disposed inside the fixing belt sandwiched between the pressing portion and the pressurizer disposed outside the fixing belt. The fixing device further includes a non-contact type temperature detector for measuring surface temperature of the fixing belt, a displacement detector for detecting a displacement of a measurement target position of the fixing belt with respect to the temperature detector, and a controller configured to adjust amount of heat generation of the heat source on the basis of the temperature detected by the temperature detector and the displacement detected by the displacement detector, so as to perform temperature adjustment of the surface temperature of the fixing belt.

20 Claims, 16 Drawing Sheets

FIXING DEVICE AND IMAGE FORMING APPARATUS

CROSS-REFERENCE TO RELATED APPLICATIONS

The present application claims priority under 35 U.S.C. §119 to Japanese Patent Application No. 2014-102549, filed May 16, 2014. The contents of this application are incorporated herein by reference in their entirety.

BACKGROUND OF THE INVENTION

1. Field of the Invention

The present invention relates to a fixing device including a heater and a pressurizer so as to fix a recording sheet of paper passing through a nip region between the heater and the pressurizer, and relates to an image forming apparatus including the fixing device.

2. Discussion of the Background

Conventionally, in an electrophotographic image forming apparatus, a recording sheet of paper with a transferred unfixed toner image is conveyed to a fixing nip region between the heater heated by a heat source and a pressurizer pressed to the heater, so as to be heated and pressed, and hence the unfixed toner image is fixed onto the recording sheet of paper, as widely performed. As the fixing device for fixing toner onto the recording sheet of paper, there is a conventional one in which a fixing belt is heated by heating means such as a halogen heater or a ceramic heater, and the recording sheet of paper is pressed to the fixing belt by pressure.

In recent years, in order to reduce emission of ultrafine particles and power consumption, the fixing device is required to set the temperature to a limit value that can secure the fixing strength. For this reason, highly accurate control is necessary for adjusting temperature of the fixing device, and therefore a non-contact thermistor that does not damage the surface of the fixing belt is usually used as a temperature sensor for measuring surface temperature of the fixing belt.

There is proposed a fixing device for performing the above-mentioned temperature control, including the temperature sensor disposed at a part of the fixing belt where thermal deformation is apt to occur (see Japanese Unexamined Patent Application Publication 2013-164438). In addition, there is proposed a fixing device including the temperature sensor for temperature control, and displacement detection means for detecting deformation of a heating pipe to be a heating member via the fixing belt, so as to prevent breakage of a component of the fixing device (see Japanese Unexamined Patent Application Publication 2013-057896).

However, a non-contact temperature sensor has a large dependence on distance to the object to be measured. In a structure of locally heating the fixing belt, the thermal deformation of the fixing belt causes deterioration of measurement accuracy of the temperature sensor. In particular, when using a free belt type fixing belt, a distance between the fixing belt and the temperature sensor is apt to vary. As a result, surface temperature of the fixing belt may not be accurately detected, and hence abnormality of the temperature control may occur.

In the structure of Japanese Unexamined Patent Application Publication 2013-164438, the temperature sensor is disposed at a position that can reduce influence of thermal deformation of the fixing belt, but the dependence on distance to the object to be measured causes detection error of the temperature sensor. As a result, the fixing device required to perform high accuracy temperature control is largely affected by a small error, resulting in a malfunction such as insufficient fixation of toner on the recording sheet of paper.

In addition, in the structure of Japanese Unexamined Patent Application Publication 2013-057896, thermal deformation of the fixing belt or the heating member is detected by the displacement detection means of a contact type, but a detection result of the displacement detection means is not reflected on the temperature control based on a measurement result of the temperature sensor. For this reason, the structure cannot perform high accuracy temperature control though it can prevent breakage of a component of the fixing device due to thermal deformation. Further, because the displacement detection means is a contact type, when the displacement detection means become a non-contact state with the fixing belt, displacement thereof cannot be measured, and hence a correction process in the temperature control cannot be performed.

SUMMARY OF THE INVENTION

In view of the above-mentioned problem, it is an object of the present invention to provide a fixing device capable of performing high accuracy temperature control and an image forming apparatus including the fixing device.

In order to achieve this object, a fixing device according to an aspect of the present invention includes a pressurizer constituted of a rotating body, a heater including a heat source, a fixing belt heated by the heat source, and a pressing portion disposed inside the fixing belt sandwiched between the pressing portion and the pressurizer disposed outside the fixing belt. The fixing device further includes a non-contact type temperature detector for measuring surface temperature of the fixing belt, a displacement detector for detecting a displacement of a measurement target position of the fixing belt with respect to the temperature detector, a controller configured to adjust amount of heat generation of the heat source on the basis of the temperature detected by the temperature detector and the displacement detected by the displacement detector, so as to perform temperature adjustment of the surface temperature of the fixing belt.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

An embodiment of the present invention is now described below with reference to the drawings, which is a case where the present invention is applied to a tandem type color digital printer as an example of an image forming apparatus.

Figure 1:
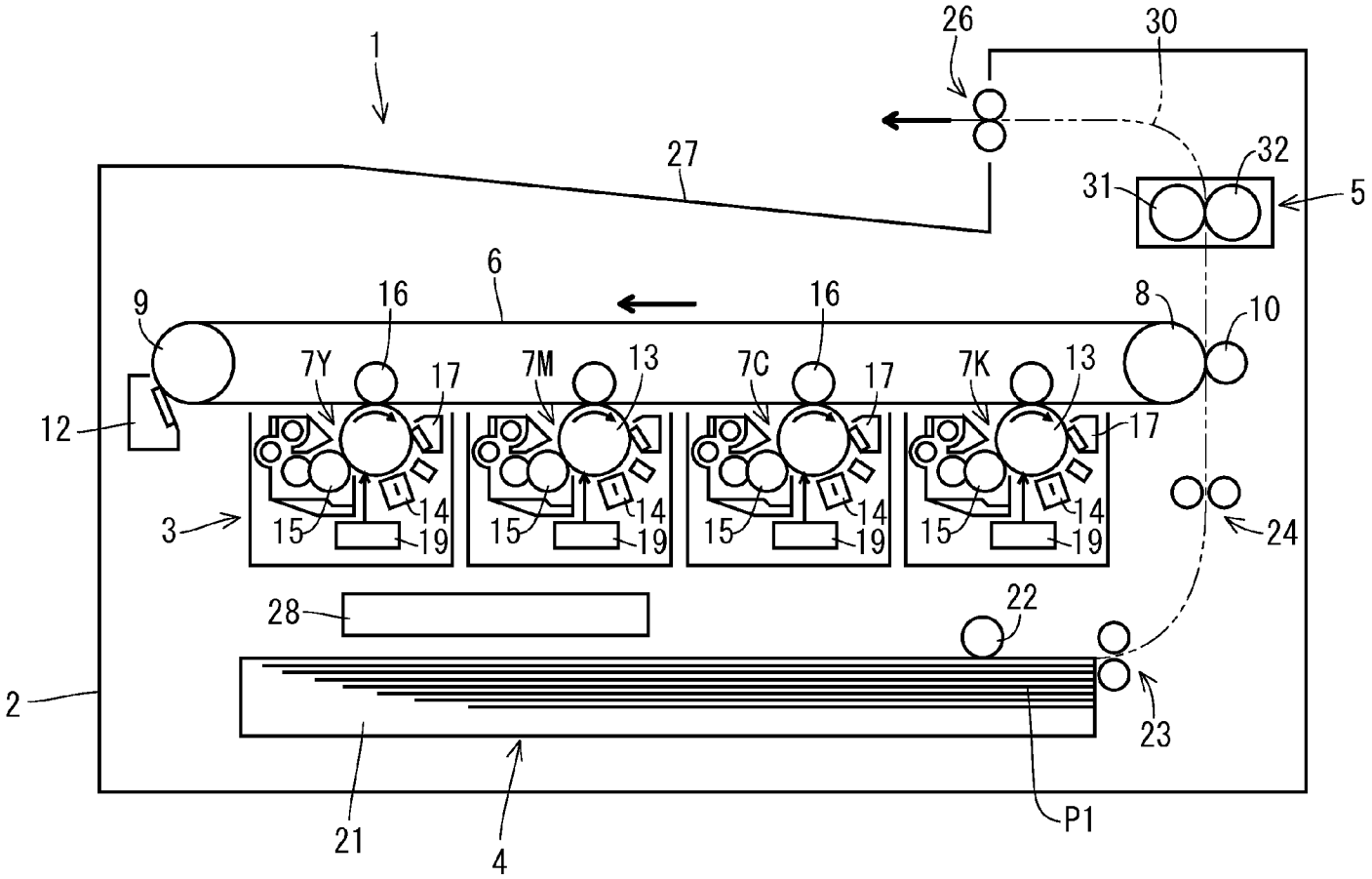
FIG. 1 is a schematic structural diagram showing an inside structure of an image forming apparatus according to an embodiment of the present invention.

In the following description, terms (for example, "left and right" and "upper and lower") indicating specific directions and positions are used where necessary. In this respect, the direction perpendicular to the paper plane of FIG. 1 is defined as front view. The terms are used for the sake of description and not intended to limit the technical scope of the present invention.

<General Arrangement of Image Forming Apparatus>

A general arrangement of the image forming apparatus 1 is described below with reference to FIG. 1. As shown in FIG. 1, an image forming apparatus 1 includes, in a casing 2 thereof, an image processing device 3, a sheet feeding device 4, a fixing device 5, and the like. Although detailed illustration is omitted, the image forming apparatus 1 is connected to a network such as a LAN, and is configured to perform printing on the basis of a print command when accepting the command from an external terminal (not shown).

The sheet feeding device 4 disposed in a lower part inside the casing 2 includes a sheet feed cassette 21 storing recording sheets of paper P1, a pickup roller 22 for sending out the recording sheets of paper P1 from the top sheet in the sheet feed cassette 21, a pair of separation rollers 23 for separating the sent-out recording sheets of paper P1 one by one, a pair of timing rollers 24 for conveying the separated recording sheet of paper P1 to the image processing device 3 at a predetermined timing, and the like. The recording sheets of paper P1 in the sheet feed cassette 21 are sent to a conveyance path 30 one by one from the top sheet when the pickup roller 22 and the pair of separation rollers 23 rotate. The conveyance path 30 extends from the sheet feed cassette 21 of the sheet feeding device 4 to a pair of discharge rollers 26 disposed at an upper part of the casing 2 via a nip portion of the pair of timing rollers 24, a secondary transfer nip portion of the image processing device 3, and a fixing nip portion of the fixing device 5.

The recording sheets of paper P1 in the sheet feed cassette 21 are set so that the center of the paper width becomes a center reference for conveying the sheet toward the conveyance path 30. In the sheet feed cassette 21, there is a pair of side restricting plates (not shown) for adjusting a widthwise position of the recording sheet of paper P1 to the center reference before feeding the sheet. The pair of side restricting plates are arranged to move opposite to each other in the paper width direction. When the recording sheets of paper P1 in the sheet feed cassette 21 are sandwiched by the pair of side restricting plates in the paper width direction, the recording sheets of paper P1 of any size in the sheet feed cassette 21 are set to the center reference. As a result, a transferring process in the image processing device 3 and a fixing process in the fixing device 5 are performed by the center reference.

The image processing device 3 positioned above the sheet feeding device 4 has a role of transferring a toner image formed on a photoreceptor drum 13 as an example of an image carrier onto the recording sheet of paper P1, and includes an intermediate transfer belt 6 as an intermediate transferring body, four image forming sections 7 corresponding to yellow (Y), magenta (M), cyan (C) and black (K) colors, and the like.

The intermediate transfer belt 6 is an endless belt made of a conductive material and is also an example of the image carrier. The intermediate transfer belt 6 is stretched around a driving roller 8 positioned at the middle right side and a driven roller 9 positioned at the middle left side in the casing 2. A secondary transfer roller 10 is disposed outside the part of the intermediate transfer belt 6 wound around the driving roller 8. When a main motor (not shown) transmits driving force, the driving roller 8 is driven to rotate in a counterclockwise direction in FIG. 1, and hence the intermediate transfer belt 6 turns in the counterclockwise direction in FIG. 1.

The secondary transfer roller 10 is disposed outside the part of the intermediate transfer belt 6 wound around the driving roller 8. The secondary transfer roller 10 contacts with the intermediate transfer belt 6, so as to form a secondary transfer nip portion as a secondary transfer region between the intermediate transfer belt 6 and the secondary transfer roller 10 (contacting portions). The secondary transfer roller 10 rotates in a clockwise direction in FIG. 1 together with rotation of the intermediate transfer belt 6 or together with movement of the recording sheet of paper P1 sandwiched and conveyed by the secondary transfer nip portion. A transfer belt cleaner 12 for removing untransferred toner on the intermediate transfer belt 6 is disposed outside the part of the intermediate transfer belt 6 wound around the driven roller 9. The transfer belt cleaner 12 contacts with the intermediate transfer belt 6.

The four image forming sections 7 are disposed along the intermediate transfer belt 6 under the intermediate transfer belt 6 in order of yellow (Y), magenta (M), cyan (C) and black (K) from left in FIG. 1. As shown in FIG. 1, for convenience sake of description, the image forming sections 7 are denoted with suffix characters of Y, M, C and K corresponding to colors to be reproduced. Each image forming section 7 includes a photoreceptor drum 13 as an example of the image carrier rotating in the clockwise direction in FIG. 1. A charging device 14, an exposing device 19, a developing device 15, a primary transfer roller 16, and a photoreceptor cleaner 17 are disposed around the photoreceptor drum 13 in order of the clockwise rotation direction in FIG. 1.

The photoreceptor drum 13 is a negative charge type and is configured to rotate in the clockwise direction in FIG. 1 by a driving force transmitted from the main motor. The charging device 14 is applied with a charge bias voltage output from a charge power supply (not shown) at a predetermined timing. The developing device 15 develops an electrostatic latent image formed on the photoreceptor drum 13 by reversal development using toner with negative charge.

The primary transfer roller 16 is positioned inside the intermediate transfer belt 6 and sandwiches the intermediate transfer belt 6 with the photoreceptor drum 13 of the corresponding image forming section 7. The primary transfer roller 16 also rotates in the counterclockwise direction in FIG. 1 when the intermediate transfer belt 6 turns. A primary transfer nip portion as a primary transfer region is formed between the intermediate transfer belt 6 and the primary transfer roller 16 (contacting portions). The photoreceptor cleaner 17 is a member for removing untransferred toner remaining on the photoreceptor drum 13 and contacts with the photoreceptor drum 13. The exposing device 19 is disposed below each of the four image forming sections 7. The exposing device 19 forms the electrostatic latent image on each photoreceptor drum 13 with a laser beam on the basis of image information from the external terminal or the like.

On the most downstream side in the turning direction of the intermediate transfer belt 6, namely between the secondary transfer nip portion and the image forming section 7K closest to the secondary transfer roller 10, there is disposed an IDC sensor 20 for detecting density of the toner image on the intermediate transfer belt 6. The IDC sensor 20 is basically a sensor for detecting a standard pattern (or a test toner image) of each color formed on the intermediate transfer belt 6 when performing an image stabilization process for correcting color deviation, gradation, and image density. Further, hoppers (not shown) for storing toner to be supplied to the developing devices 15 are disposed above the intermediate transfer belt 6.

In each image forming section 7, when the photoreceptor drum 13 charged by the charging device 14 is irradiated with the laser beam from the exposing device 19 corresponding to the image signal, the electrostatic latent image is formed. The electrostatic latent image is reversal-developed with the toner supplied from the developing device 15 and becomes the toner image of each color. The toner images on the photoreceptor drums 13 are primarily transferred and overlaid on the outer circumference surface of the intermediate transfer belt 6 at the corresponding primary transfer nip portions in order of yellow, magenta, cyan and black. The untransferred toner remaining on the photoreceptor drum 13 is scraped by the photoreceptor cleaner 17 and removed from the surface of the photoreceptor drum 13. Further, when the recording sheet of paper P1 passes through the secondary transfer nip portion, the overlaid four color toner images are secondarily transferred onto the recording sheet of paper P1 at one time. The untransferred toner remaining on the intermediate transfer belt 6 is scraped by the transfer belt cleaner 12 and removed from the surface of the intermediate transfer belt 6.

The fixing device 5 positioned above the secondary transfer roller 10 in the image processing device 3 includes a heater (fixing unit) 31 with a built-in heat source such as a halogen lamp heater, and a pressurizer 32 opposed to the heater 31. The contacting portions of the heater 31 and the pressurizer 32 form the fixing nip portion as the fixing region. The recording sheet of paper P1 with the unfixed toner image after passing through the secondary transfer nip portion is heated and pressed when passing through the fixing nip portion between the heater 31 and the pressurizer 32, and hence the unfixed toner image is fixed onto the recording sheet of paper P1. After that, the recording sheet of paper P1 is discharged onto a sheet discharge tray 27 when the pair of discharge rollers 26 rotate.

A controller 28 configured to generally control the image forming apparatus 1 is disposed between the image processing device 3 and the sheet feeding device 4 inside the casing 2. The controller 28 includes a control unit (not shown) configured to perform various calculation processes, storing processes and control processes.

<Structure of Fixing Device>

Figure 2:
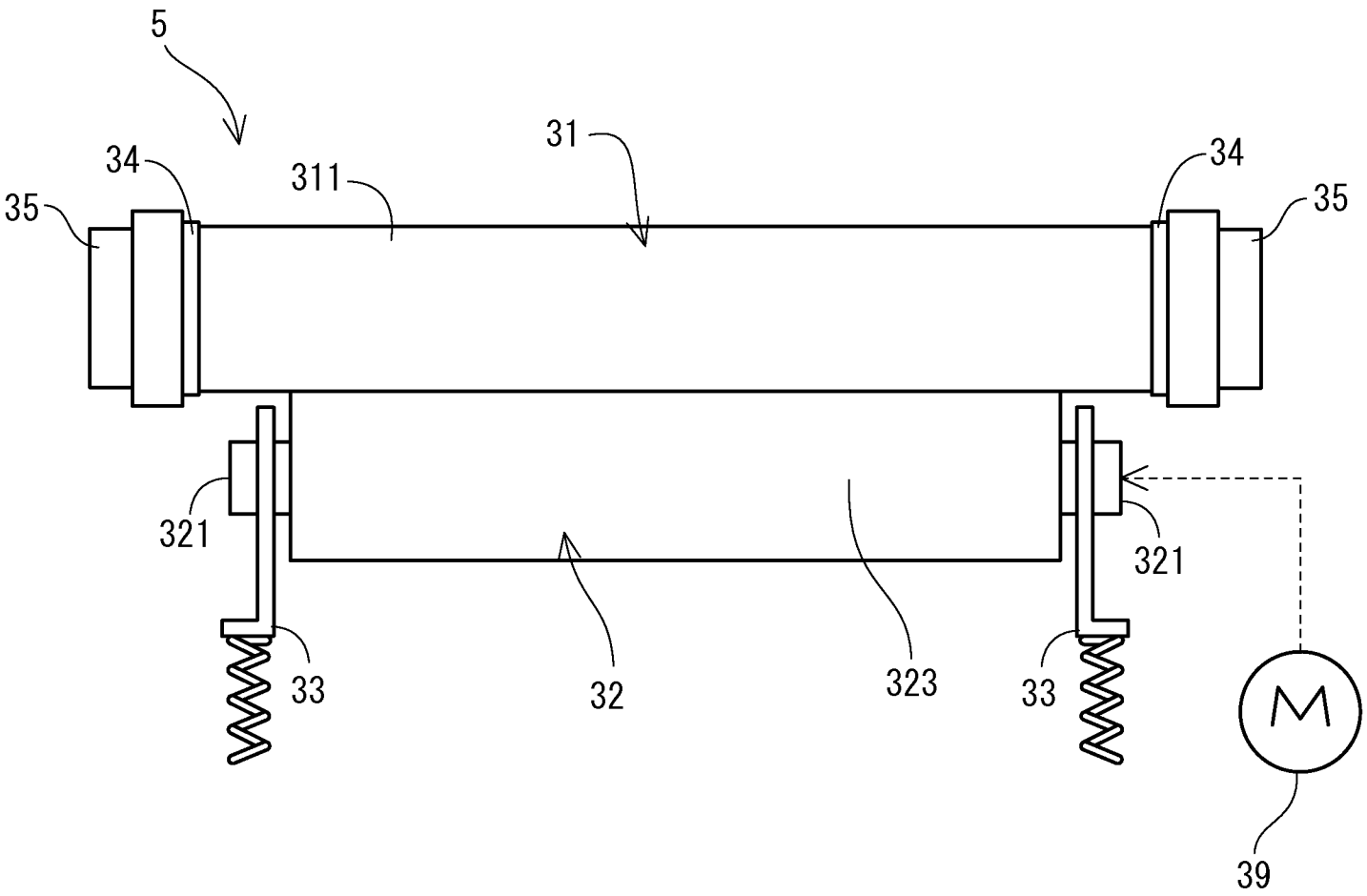
FIG. 2 is a schematic diagram showing a structure of a fixing device according to the embodiment of the present invention.
Figure 3:
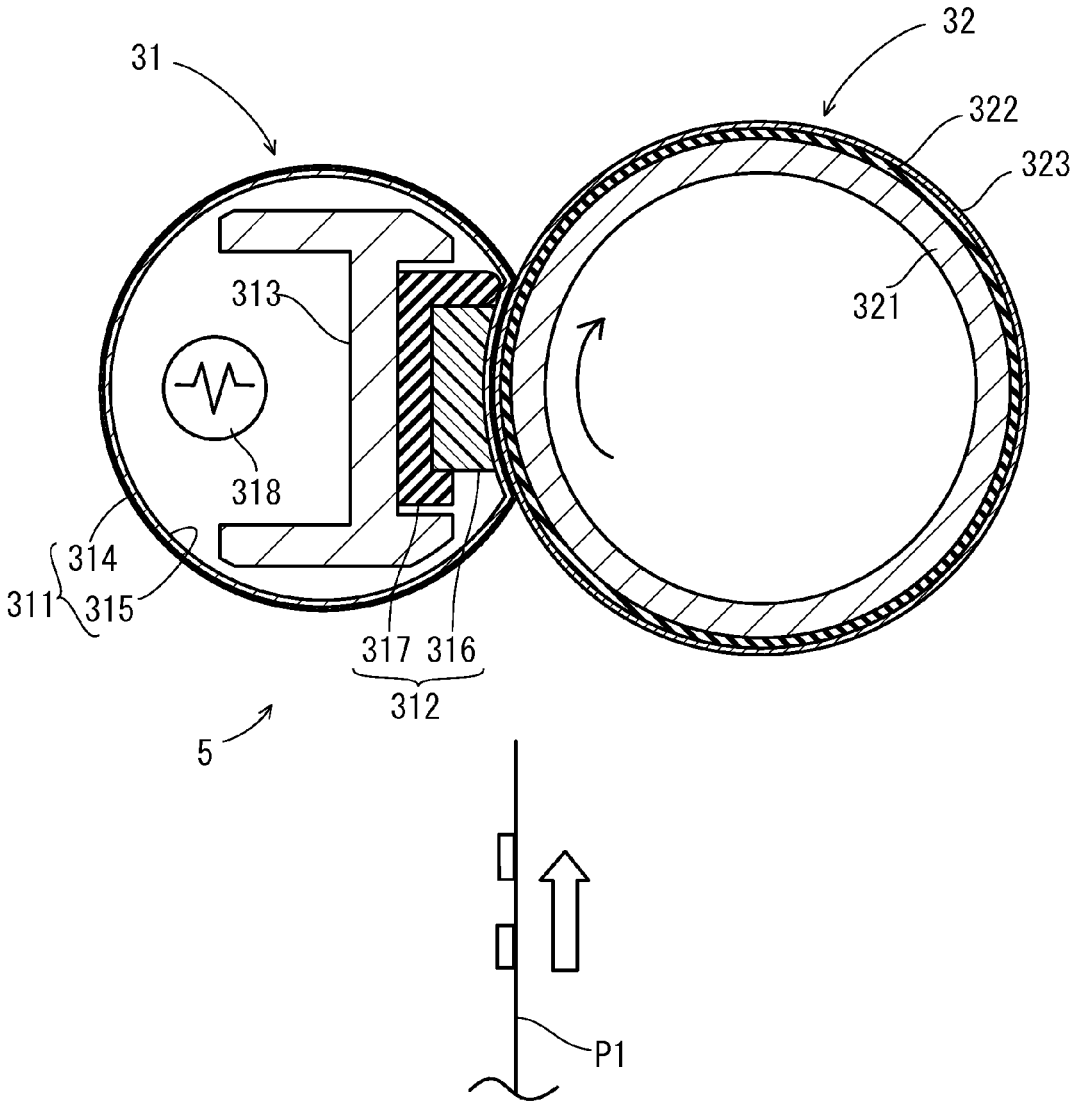
FIG. 3 is a schematic cross-sectional view showing an inside structure of the fixing device of FIG. 2.
Figure 4:
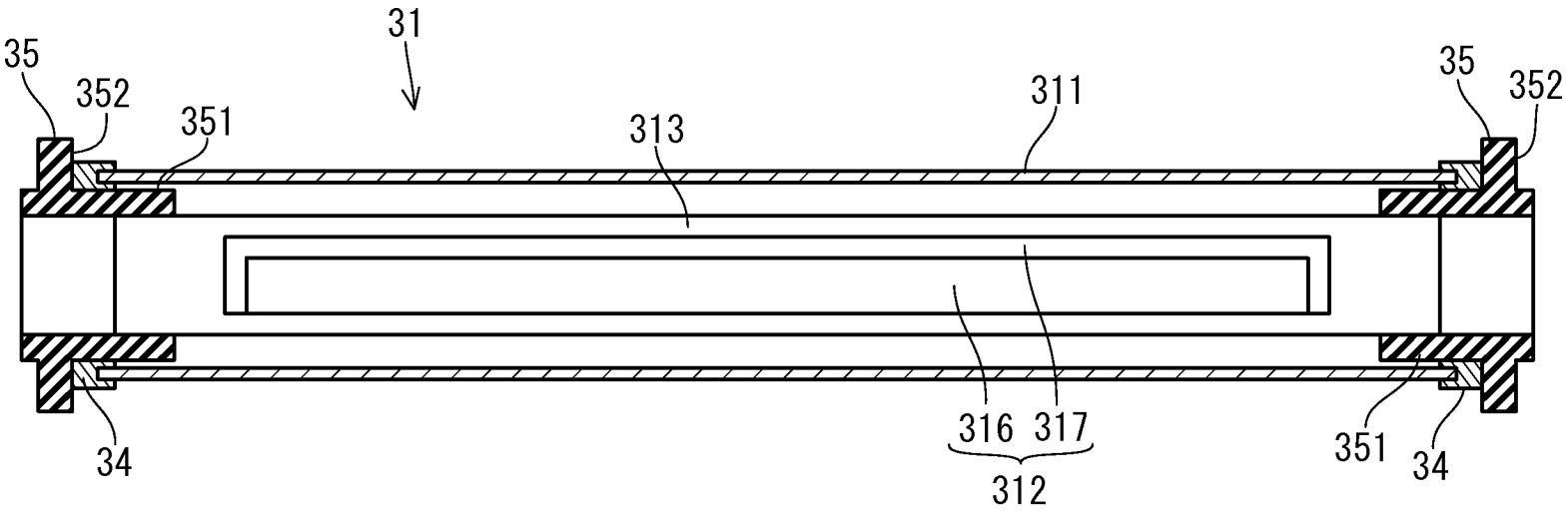
FIG. 4 is a schematic cross-sectional view showing a structure for holding a fixing belt in the fixing device of FIG. 2.

A structure of the fixing device in the image forming apparatus according to this embodiment is described below with reference to the drawings. FIG. 2 is a schematic diagram showing a structure of the fixing device in the image forming apparatus of this embodiment. FIG. 3 is a schematic cross-sectional view of the fixing device, and FIG. 4 is a schematic cross-sectional view showing a structure for holding a fixing belt 311.

As shown in FIG. 2, the fixing device 5 in the image forming apparatus 1 of this embodiment includes the heater 31 configured to press the fixing belt 311 as an endless belt to the pressurizer 32, and the pressurizer 32 constituted of a press roller with a cylindrical core metal 321 as the shaft. The core metal 321 is pivoted by a roller support frame 33 and is connected to a driving motor 39 (see FIG. 5) described later so as to receive the driving force, and hence the pressurizer 32 is driven to rotate. In addition, the fixing belt 311 is held between guide members 35 at both edges via seal members 34, so that the heater 31 is supported at the position of pressing the pressurizer 32 to form the fixing nip portion. Thus, the fixing belt 311 of the heater 31 rotates to follow the rotation of the pressurizer 32.

As shown in FIG. 3, the heater 31 includes a pressing member (sliding pad) 312 disposed inside the fixing belt 311 so as to press the fixing belt 311 to the pressurizer 32. In order to arrange the pressing member 312 to press the fixing belt 311 from inside, a holding frame 313 for fixing the pressing member 312 is disposed inside the fixing belt 311. Further, inside the fixing belt 311, there is a heat source 318 for heating the heater 31 up to a predetermined target temperature (e.g., fixing temperature within the range of 160 to 200 degrees Celsius) so as to extend in the paper width direction.

The fixing belt 311 includes an inner base layer 315 having heat resistance, strength, and surface smoothness, and a release layer 314 having a release property and covering the outside of a base layer 325. The pressing member 312 includes an elastic pressing member 316 for deforming and pressing the fixing belt 311, and a rigid pressing member 317 made of a material having a hardness higher than that of the elastic pressing member 316, and has a structure in which the elastic pressing member 316 is held by the rigid pressing member 317. In addition, a halogen heater, an induction heater, a resistance heating element or the like is used as the heat source 318.

The pressurizer 32 has a structure in which an elastic layer 322 and a release layer 323 are sequentially coated on the outer circumference surface of the core metal 321 made of a metal material. The elastic layer 322 is made of an elastic material with heat resistance, and has heat resistance to the fixing temperature and elasticity for ensuring a length of the fixing nip portion. The release layer 323 has heat resistance to the fixing temperature, release property for helping separation of the recording sheet of paper P1 after passing through the fixing nip portion, and property of hardly transmitting ultrafine particles generated from the elastic layer 322 (gas barrier property). Because the roller support frame 33 is biased and supported by a spring, the pressurizer 32 contacts to press the fixing belt 311.

With the structure described above, the elastic pressing member 316 and the rigid pressing member 317 sequentially press the fixing belt 311 from the downstream side to the upstream side in the conveyance direction of the recording sheet of paper P1, and hence the toner image is fixed to the recording sheet of paper P1. In other words, the recording sheet of paper P1 is heated and pressed in the fixing nip portion formed by pressure due to elastic deformation of the elastic pressing member 316, and thus the toner on the sheet of paper is melted and fixed. After that, the highly rigid pressing member 317 presses the pressurizer 32 via the fixing belt 311 so as to deform the elastic layer 322 of the pressurizer 32, and hence the recording sheet of paper P1 after passing through the fixing nip portion is separated.

Next, a structure of holding the fixing belt 311 is described below with reference to FIGS. 2 and 4. The guide members 35 are partially inserted inside the fixing belt 311, and the both edges of the fixing belt 311 in the width direction (left and right direction in FIGS. 2 and 4) are covered with the guide members 35. The guide member 35 includes a cylindrical frame holding portion 351 inserted inside the fixing belt 311 and a ring-like belt holding portion 352 protruded outward from the outer circumference surface of the frame holding portion 351.

The frame holding portions 351 of the guide members 35 having this structure are inserted inside the base layer 315 of the fixing belt 311 from front and rear edges of the fixing belt 311. In this way, inside the fixing belt 311, the front and rear sides of the holding frame 313 are connected to the frame holding portions 351 of the two guide members 35, and hence the two guide members 35 support the holding frame 313 therebetween. In other words, positions of the guide members 35 disposed at the front and rear ends of the fixing belt 311 are determined by the holding frame 313 held between the frame holding portions 351.

In addition, the front and rear edges of the fixing belt 311 are respectively covered with the seal members 34 fit on the outer circumference surface of the frame holding portion 351 of the guide member 35. Further, this seal member 34 contacts with and fixed to an end surface of the belt holding portion 352 of the guide member 35. In this way, the fixing belt 311 is held between the belt holding portions 352 of the guide members 35 secured on the front end rear sides of the holding frame 313 via the seal members 34, and is supported in a rotatable manner.

As shown in FIG. 4, the seal member 34 slidably contacts with an end surface and inner and outer circumference surfaces of the fixing belt 311 in the rim region so that the inside of the fixing belt 311 connected to the guide members 35 is sealed. This seal member 34 is made of an elastic material such as resin foam or rubber, and the surface thereof contacting with the rim region of the fixing belt 311 is provided with a low friction member so that the fixing belt 311 can have a good sliding property.

<Control Mechanism of Fixing Operation>

Figure 5:
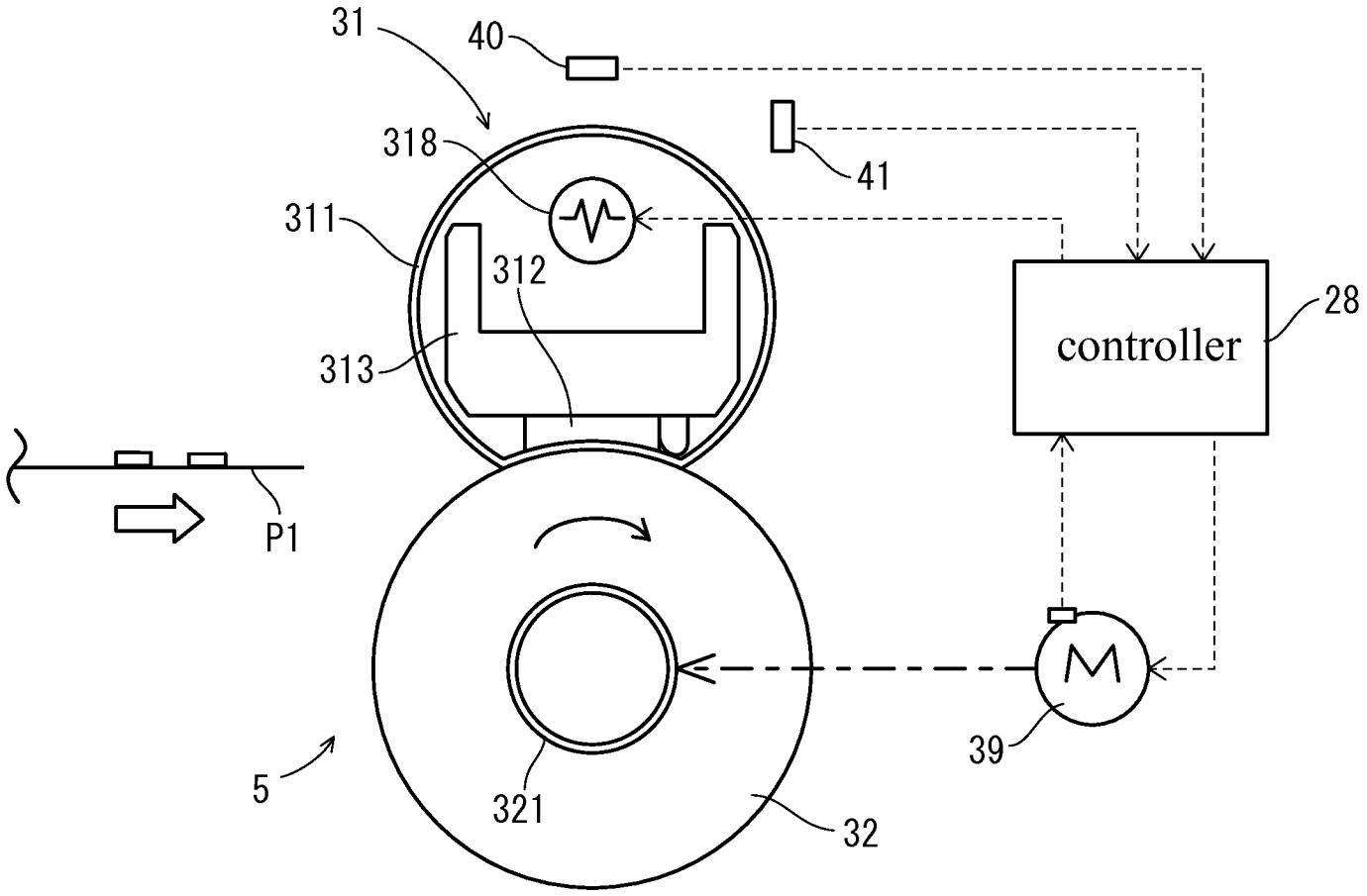
FIG. 5 is a block diagram showing a relationship between the fixing device of FIG. 2 and a controller.
Figure 6:
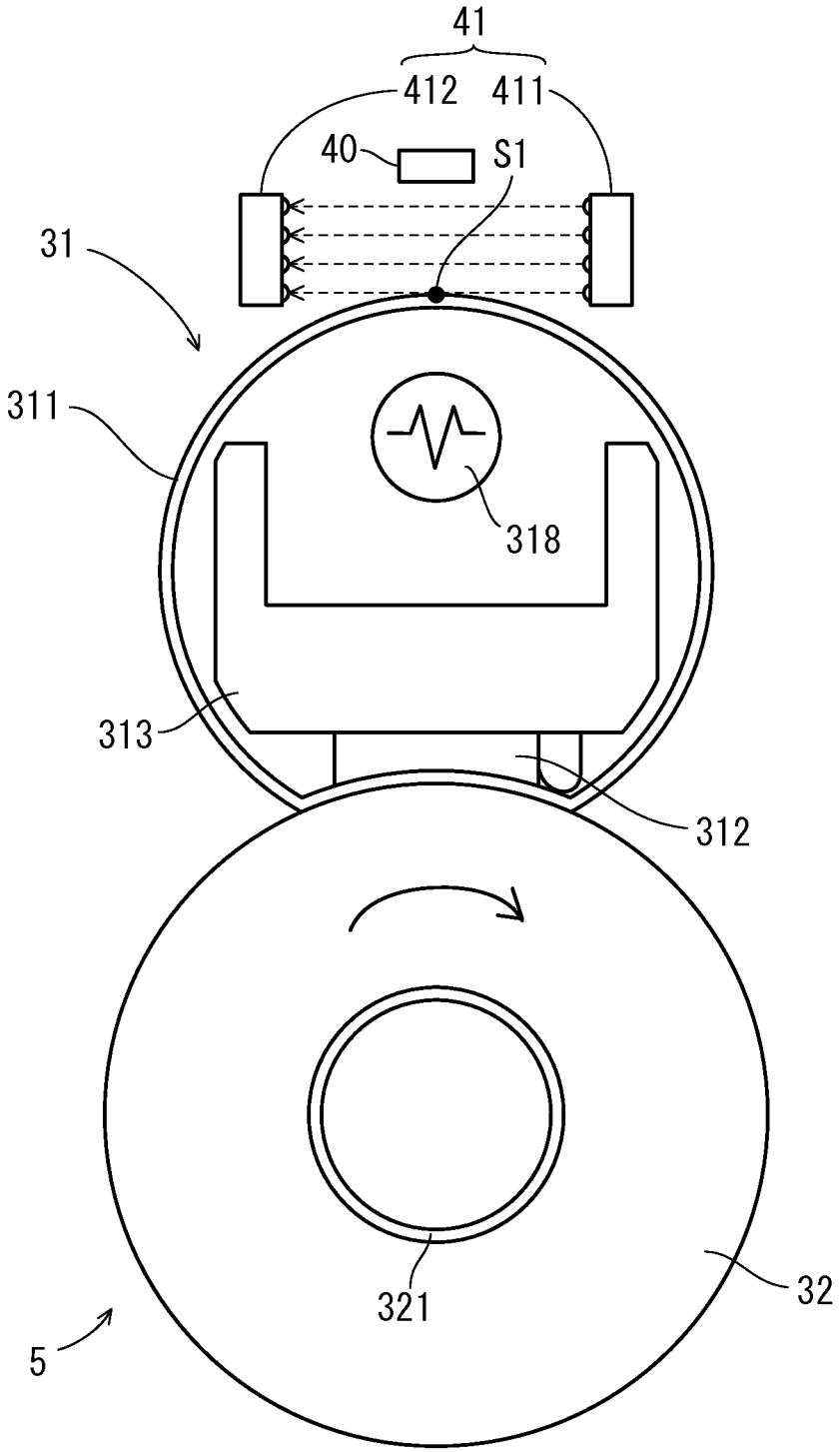
FIG. 6 is a schematic diagram showing positions of a temperature sensor and a transparent type position detection sensor in the fixing device.
Figure 7:
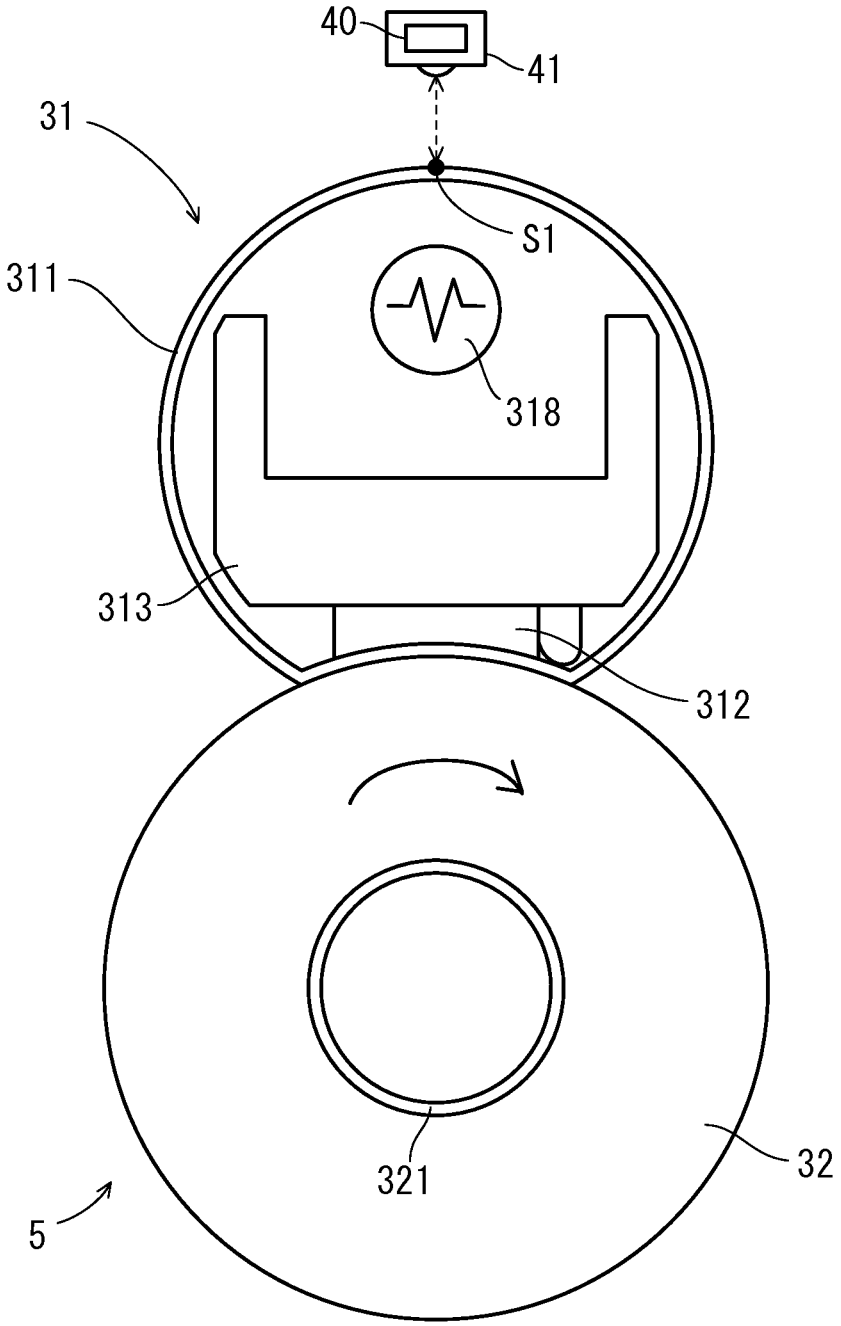
FIG. 7 is a schematic diagram showing positions of the temperature sensor and a reflection type position detection sensor in the fixing device.
Figure 8:
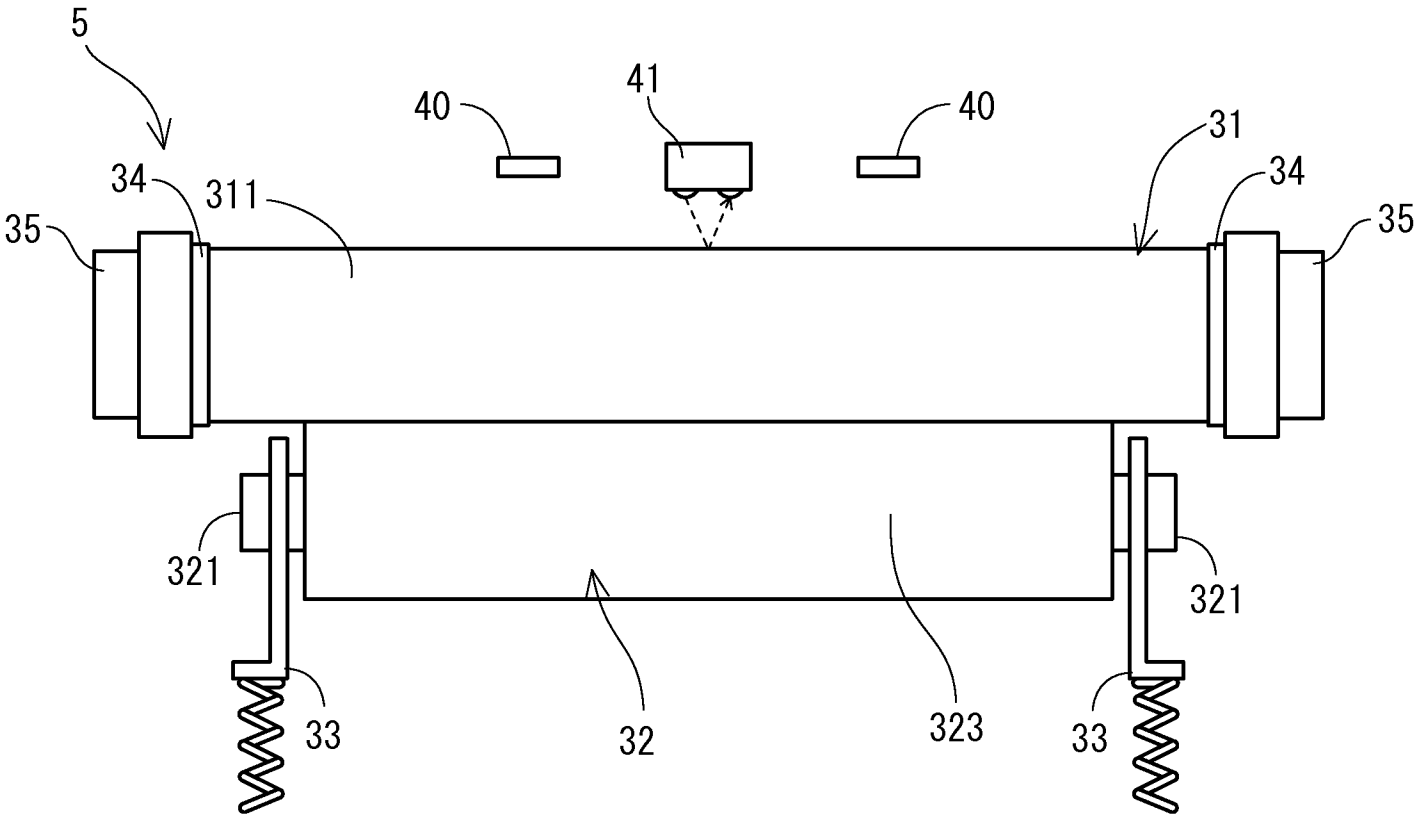
FIG. 8 is a plan view showing a positional relationship between the temperature sensor and the position detection sensor in the structure of FIG. 7.

A control mechanism of the fixing operation is described below with reference to FIG. 5. FIG. 5 is a block diagram showing a relationship between the fixing device 5 and the controller 28. FIGS. 6 to 8 are diagrams showing a positional relationship of sensors provided to the fixing device.

As shown in FIG. 5, the fixing device 5 includes a temperature sensor (temperature detector) 40 for measuring surface temperature of the fixing belt 311 and a position detection sensor (displacement detector) 41 for measuring a surface position of the fixing belt 311. If the temperature sensor 40 is a contact type, it may damage the surface of the fixing belt 311 to be measured. For this reason, a non-contact type such as a thermistor is used. The position detection sensor 41 is an optical sensor using light emission and reception elements, and may be a distance measuring sensor for measuring distance based on amount of light reflected from the surface of the fixing belt 311 or may be a position detection sensor disposed at the side of the fixing belt 311 so as to detect a surface position of the fixing belt 311 based on amount of transmitted light.

The temperature sensor 40 is disposed at a position as an outer periphery of the fixing belt 311 so that the measuring surface is opposed to the surface of the fixing belt 311. The position detection sensor 41 is disposed at a position suitable for measuring a region adjacent to a measurement target position of the fixing belt 311 by the temperature sensor 40. In this case, it is preferred that the position detection sensor 41 is disposed at a position for measuring a center region of the fixing belt 311 in the width direction (left and right direction in FIGS. 2 and 4). In other words, because heat is apt to be confined more in the middle portion than in the end portion of the fixing belt 311 so that the thermal deformation is larger in the middle portion, the position detection sensor 41 is disposed at the center of the fixing belt 311 in a longitudinal direction (left and right direction in FIGS. 2 and 4). In this way, the position detection sensor 41 can easily measure a displacement of the distance between the temperature sensor 40 and the surface of the fixing belt 311.

In other words, as shown in FIGS. 6 and 7, when the temperature sensor 40 is disposed on the opposite side of the pressurizer 32 with respect to the heater 31, the temperature sensor 40 measures a vertex position S1 of the fixing belt 311 on the opposite side of the fixing nip region with the pressurizer 32. In other words, the measurement target position S1 by the temperature sensor 40 is the farthest position (vertex position) from the pressurizer 31 along the circumferential direction of the fixing belt 311. Further, the position detection sensor 41 is disposed at a position suitable for measuring the distance between the measurement target position S1 of the fixing belt 311 and the temperature sensor 40.

When the position detection sensor 41 is a transparent type sensor, as shown in FIG. 6, a light emitting part 411 including a plurality of light emitting elements (laser diodes) for emitting laser beams and a light receiving part 412 including a plurality of light receiving elements (photodiodes or phototransistors) for respectively receiving the laser beams emitted from the light emitting part 411 are disposed to face each other with respect to the vertex position S1 of the fixing belt 311, and thus the position detection sensor 41 is constituted. In other words, the light emitting part 411 and the light receiving part 412 of the position detection sensor 41 are symmetrically disposed with respect to the normal to the fixing belt 311 at the measurement target position S1.

In addition, the light emitting elements of the light emitting part 411 and the light receiving elements of the light receiving part 412 are respectively arranged in a line from the measurement target position S1 of the fixing belt 311 toward the temperature sensor 40. As a result, in the position detection sensor 41, the light receiving part 412 receives a part of laser beams emitted from the light emitting part 411 to the light receiving part 412, i.e., only the laser beams emitted from the light emitting elements positioned closer to the temperature sensor 40 than the surface of the fixing belt 311. Then, the position detection sensor 41 informs the controller 28 of the positions of the light receiving elements that have received the laser beams in the light receiving part 412. Thus, the controller 28 knows the distance between the measurement target position S1 of the fixing belt 311 and the temperature sensor 40.

When the position detection sensor 41 is a reflection type sensor (distance measuring sensor), as shown in FIG. 7, the position detection sensor 41 is disposed at a position corresponding to the position of the temperature sensor 40 in the outer circumferential direction of the fixing belt 311, and includes a light emitting element for emitting a laser beam to the measurement target position S1 of the fixing belt 311 and a light emitting element for receiving reflected light from the measurement target position S1 of the fixing belt 311. In other words, as shown in FIG. 8, the temperature sensor 40 and the position detection sensor 41 are disposed side by side in the longitudinal direction (width direction) of the fixing belt 311. When the position detection sensor 41 informs the controller 28 of the amount of the reflected light received by the light receiving element, the controller 28 knows the distance between the measurement target position S1 of the fixing belt 311 and the temperature sensor 40.

The controller 28 outputs a control signal to the driving motor 39 so as to control the rotation drive of the driving motor 39 and to control rotation operation of the heater 31 and the pressurizer 32 in the fixing device 5, while the controller 28 outputs a control signal to the heat source 318 so as to control heating amount in the heater 31. In addition, the driving motor 39 (see FIG. 5) includes a rotational frequency detector (not shown) such as a Hall sensor, and informs the controller 28 of a rotation speed of the driving motor 39. The controller 28 controls the rotation operation of the driving motor 39. Further, the controller 28 adjusts temperature of the heat source 318 on the basis of the rotation speed of the driving motor 39, the measured temperature by the temperature sensor 40, and the measured position by the position detection sensor 41.

<First Example of Temperature Control Switching Operation>

Figure 9:
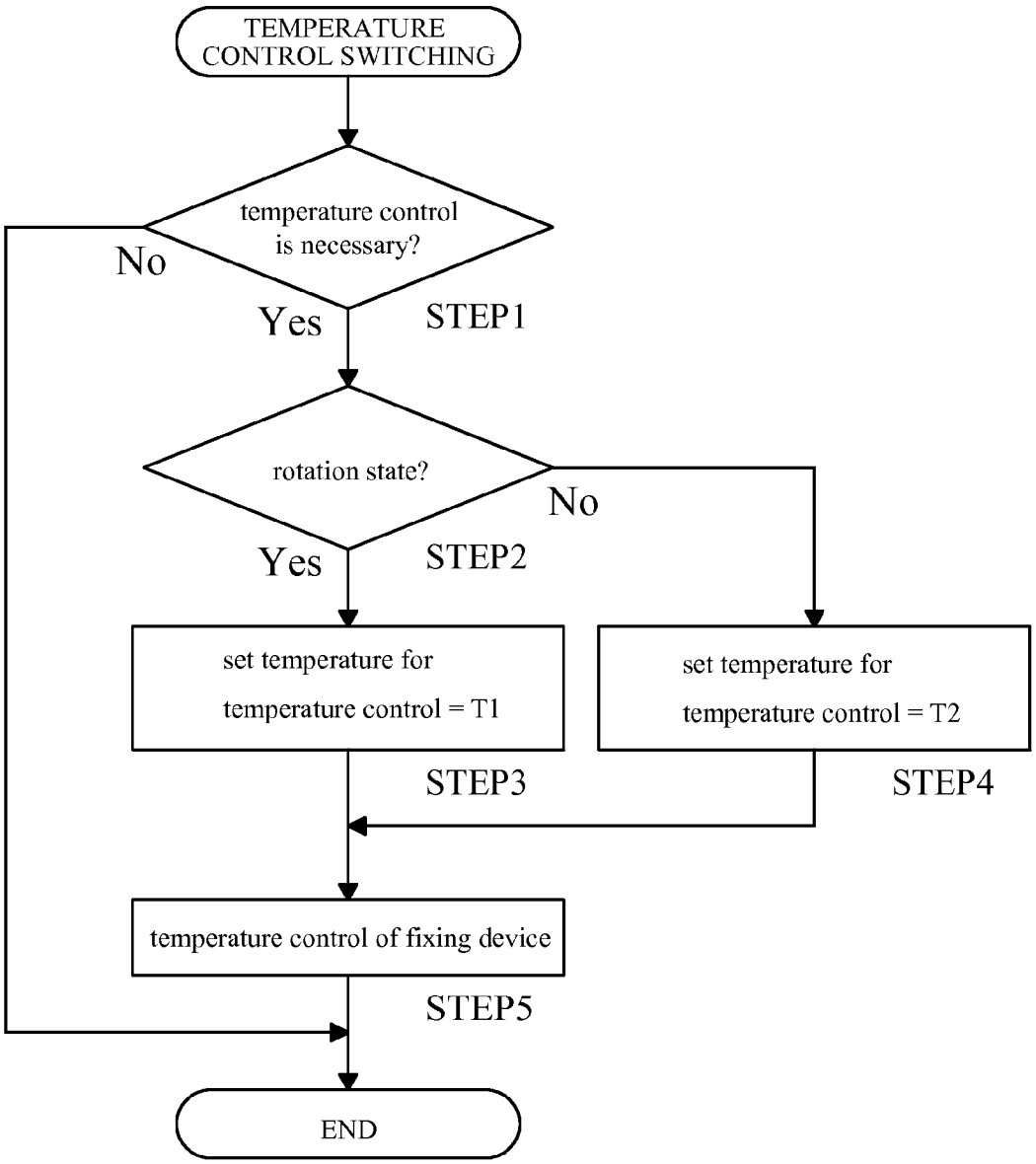
FIG. 9 is a flowchart showing a first example of a temperature control switching operation in the fixing device.

The controller 28 switches a set temperature in the temperature control in accordance with an operational state of the fixing device 5. A first example of the temperature control switching operation by the controller 28 is described below with reference to a flowchart of FIG. 9. In this example, the temperature control of the fixing belt 311 is performed by switching the set temperature of the fixing belt 311 between the rotating state in which the fixing belt 311 and the pressurizer 32 are rotating and the stop state in which the fixing belt 311 and the pressurizer 32 are not rotating.

The controller 28 checks whether or not the temperature control of the fixing belt 311 is necessary (STEP1). If the temperature control is necessary (Yes), the controller 28 determines whether or not the fixing device 5 is in the rotating state on the basis of the rotation speed informed from the driving motor 39 (STEP2). If the driving motor 39 is rotating and each of the fixing belt 311 and the pressurizer 32 in the fixing device 5 is rotating (Yes in STEP2), the controller 28 sets the set temperature of the fixing belt 311 in the temperature control to temperature T1 (STEP3). In contrast, if the driving motor 39 is stopped and each of the fixing belt 311 and the pressurizer 32 in the fixing device 5 is stopped (No in STEP2), the controller 28 sets the set temperature of the fixing belt 311 in the temperature control to temperature T2 (T2<T1) (STEP4). After setting the set temperature in STEP3 or STEP4, the controller 28 performs the temperature control described later on the basis of the set temperature (STEP5).

Figure 10C:
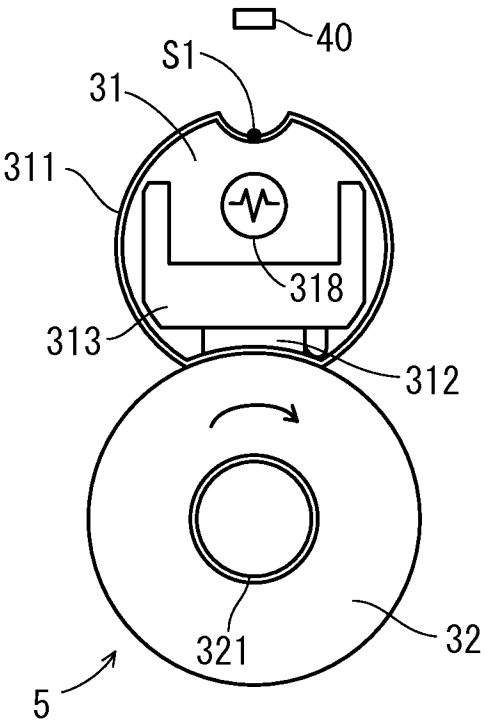
FIG. 10C shows a state of the fixing belt having a distance to the temperature sensor longer than the reference distance in the stop state of the fixing device.
Figure 10B:
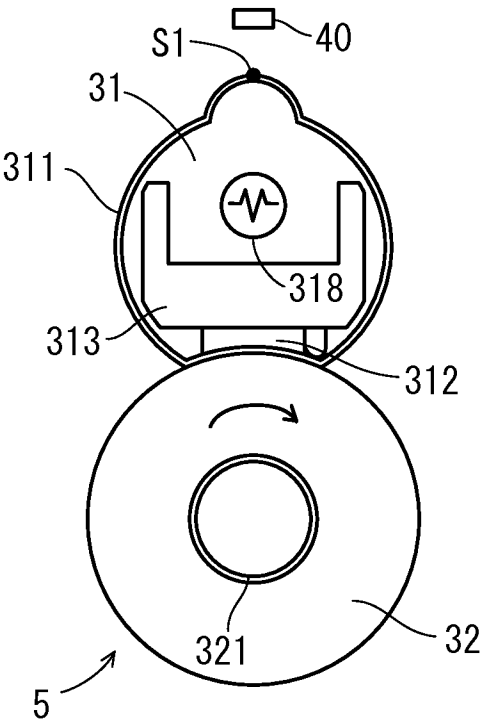
FIG. 10B shows a state of the fixing belt having a distance to the temperature sensor shorter than the reference distance in the stop state of the fixing device.
Figure 10A:
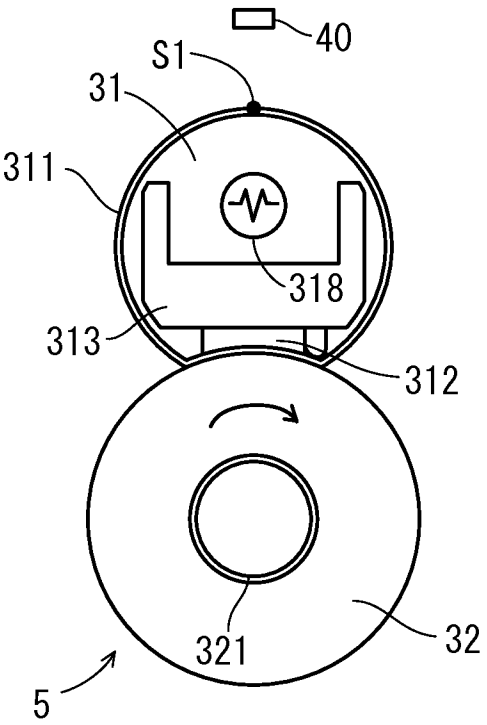
FIG. 10A shows a state of the fixing belt having a reference distance to the temperature sensor in a stop state of the fixing device.

If the image forming apparatus 1 is in a starting (warming up) state or a waiting state and the fixing device 5 heats the fixing belt 311 in the stop state (No in STEP2), the heat source 318 locally heats the fixing belt 311. As a result, the part of the fixing belt 311, which is locally heated, is thermally deformed so as to protrude as shown in FIG. 10B, and the distance between the fixing belt 311 and the temperature sensor 40 is decreased. Otherwise, the part of the fixing belt 311, which is locally heated, is thermally deformed so as to be recessed as shown in FIG. 10C, and the distance between the fixing belt 311 and the temperature sensor 40 is increased. Note that the distance between the temperature sensor 40 and the measurement target position S1 of the fixing belt 311 in the normal state with no thermal deformation of the fixing belt 311 as shown in FIG. 10A is regarded as a reference distance.

If the distance between the fixing belt 311 and the temperature sensor 40 is shorter than the reference distance as shown in FIG. 10B, the temperature sensor 40 erroneously detects a temperature higher than the case of detecting at the reference distance. Accordingly, in order to avoid insufficient heat supply by the heat source 318, it is necessary to perform a correction process in the temperature control. In this case, when the surface temperature of the fixing belt 311 in performing the temperature control at the reference distance is regarded as a reference temperature, the controller 28 performs the temperature control so that the temperature of the fixing belt 311 becomes a temperature higher than the reference temperature.

If the distance between the fixing belt 311 and the temperature sensor 40 is longer than the reference distance as shown in FIG. 10C, the temperature sensor 40 erroneously detects a temperature lower than the case of detecting at the reference distance. Accordingly, in order to avoid excess heat supply by the heat source 318, it is necessary to perform the correction process in the temperature control. In this case, when the surface temperature of the fixing belt 311 in performing the temperature control at the reference distance is regarded as the reference temperature, the controller 28 performs the temperature control so that the temperature of the fixing belt 311 becomes a temperature lower than the reference temperature.

When the position detection sensor 41 is the transparent type sensor, the light emitting part 411 and the light receiving part 412 are respectively disposed outside the both edges of the fixing belt 311, and hence the recess in the fixing belt 311 can be detected as shown in FIG. 10C. In other words, in the position detection sensor 41 of the transparent type, the laser beams are emitted from the light emitting part 411 in parallel to the longitudinal direction (width direction) of the fixing belt 311 and reach the light receiving part 412.

Figure 11B:
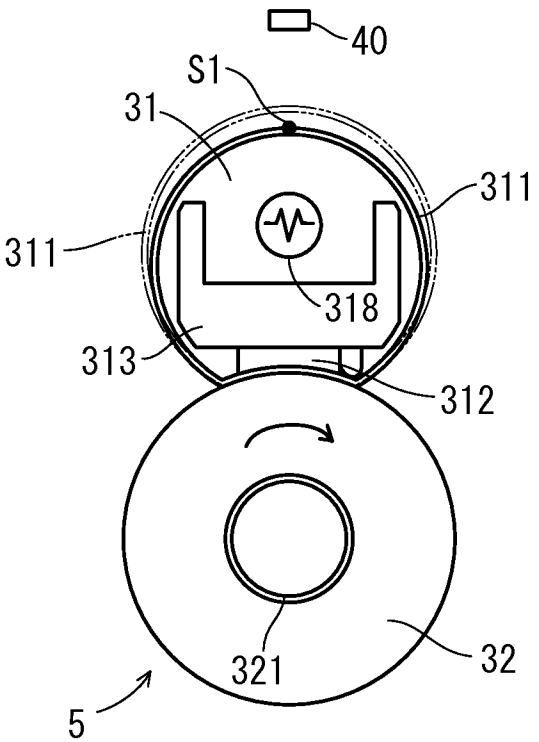
FIG. 11B shows a contracted state of the fixing belt in the rotating state of the fixing device.

When the image forming apparatus 1 performs image formation and the fixing device 5 heats the fixing belt 311 in the rotating state (Yes in STEP2), the heat source 318 heats the entire fixing belt 311. As a result, the fixing belt 311 is expanded by thermal deformation so that the distance to the temperature sensor 40 is decreased as shown in FIG. 11A, or the fixing belt 311 is contracted by thermal deformation so that the distance between the fixing belt 311 and the temperature sensor 40 is increased as shown in FIG. 11B.

Figure 11A:
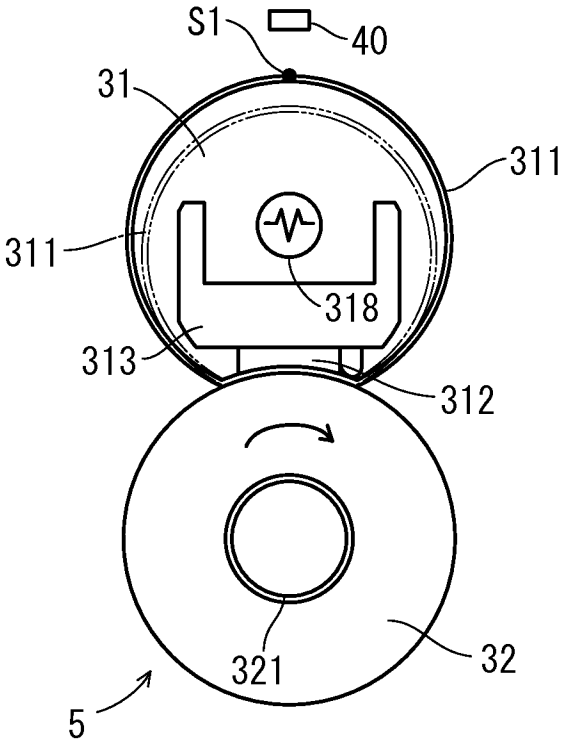
FIG. 11A shows an expanded state of the fixing belt in a rotating state of the fixing device.

When the fixing belt 311 is expanded as shown in FIG. 11A, the distance between the fixing belt 311 and the temperature sensor 40 becomes shorter than the reference distance. Accordingly, the controller 28 performs the temperature control so that the temperature of the fixing belt 311 becomes higher than the reference temperature. In contrast, when the fixing belt 311 is contracted as shown in FIG. 11B, the distance between the fixing belt 311 and the temperature sensor 40 becomes longer than the reference distance. Accordingly, the controller 28 performs the temperature control so that the temperature of the fixing belt 311 becomes lower than the reference temperature.

<Second Example of Temperature Control Switching Operation>

Figure 12:
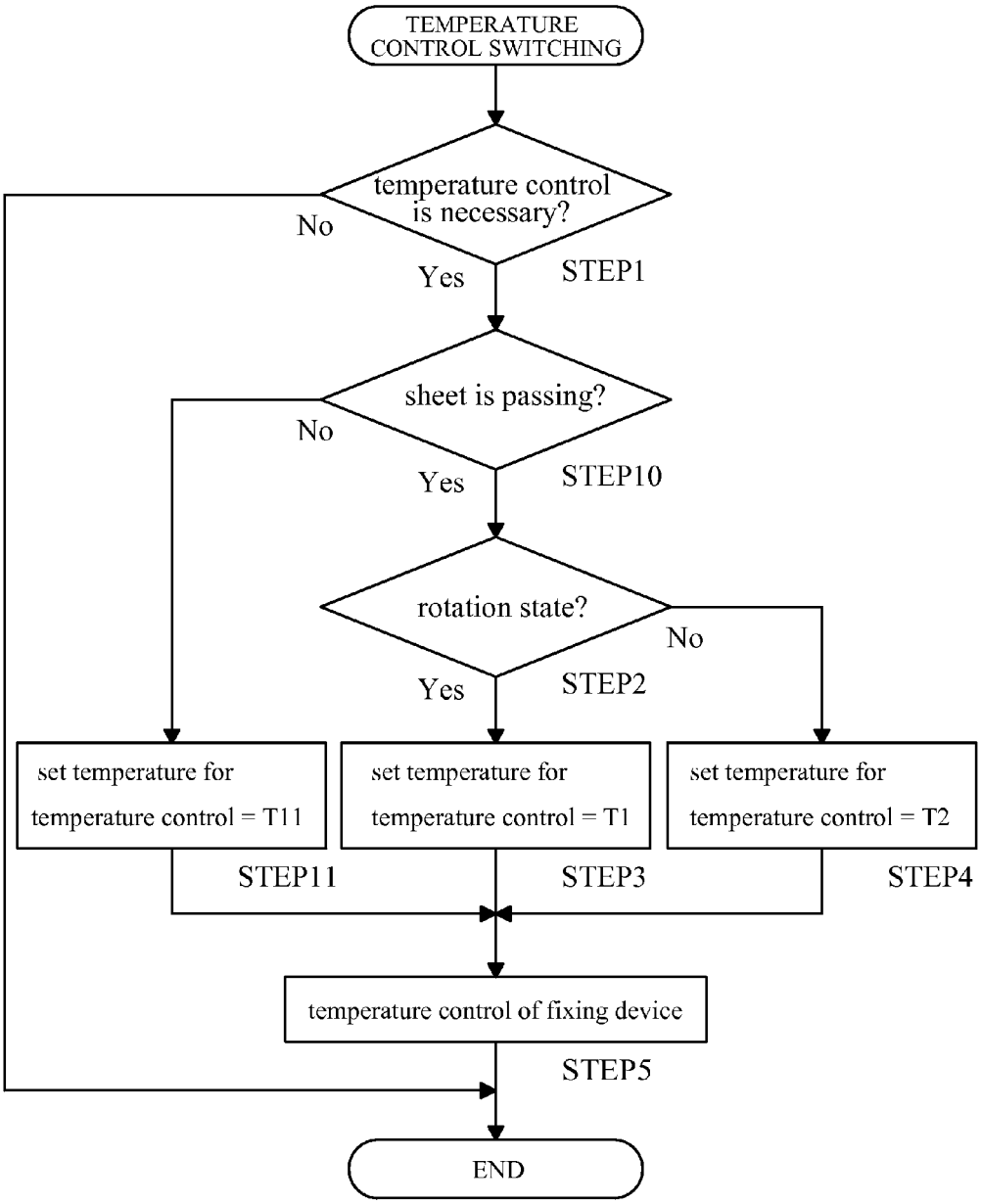
FIG. 12 is a flowchart showing a second example of the temperature control switching operation in the fixing device.

In the first example described above, the temperature control is switched between the rotating state and the stop state of the fixing device 5. In the rotating state of the fixing device 5, it is possible to further switch the set temperature in the temperature control on the basis of whether or not the recording sheet of paper P1 is passing through. In the following description, the flowchart of FIG. 12 is referred to in the second example of the temperature control switching operation by the controller 28. In this example, the same operation step as the first example described above is denoted by the same symbol, and detailed description thereof is omitted.

In this example, when the temperature control is necessary (Yes in STEP1), the controller 28 checks whether or not the recording sheet of paper P1 is passing through the fixing device 5 (STEP10). If the recording sheet of paper P1 is passing through the fixing device 5 (Yes in STEP10), the controller 28 sets the set temperature of the fixing belt 311 in the temperature control to temperature T11 (STEP11). The controller 28 checks whether or not the recording sheet of paper P1 is passing through the fixing device 5 by checking position of the recording sheet of paper P1 in the conveyance passage on the basis of a signal from a conveyance sensor (not shown) disposed in the conveyance passage for the recording sheet of paper P1.

On the other hand, when the recording sheet of paper P1 is passing through the fixing device 5 (Yes in STEP10), the controller 28 determines whether or not the fixing device 5 is in the rotating state (STEP2). If the fixing device 5 is in the rotating state (Yes in STEP2), the controller 28 sets the set temperature to temperature T12 (T12<T11) (STEP3). If the fixing device 5 is in the stop state (No in STEP3), the controller 28 sets the set temperature to the temperature T2 (T2<T12) (STEP4). After setting the set temperature in STEP11, STEP3 or STEP4, the controller 28 performs the temperature control described later on the basis of the set temperature (STEP5).

<First Example of Temperature Control Operation>

Figure 13:
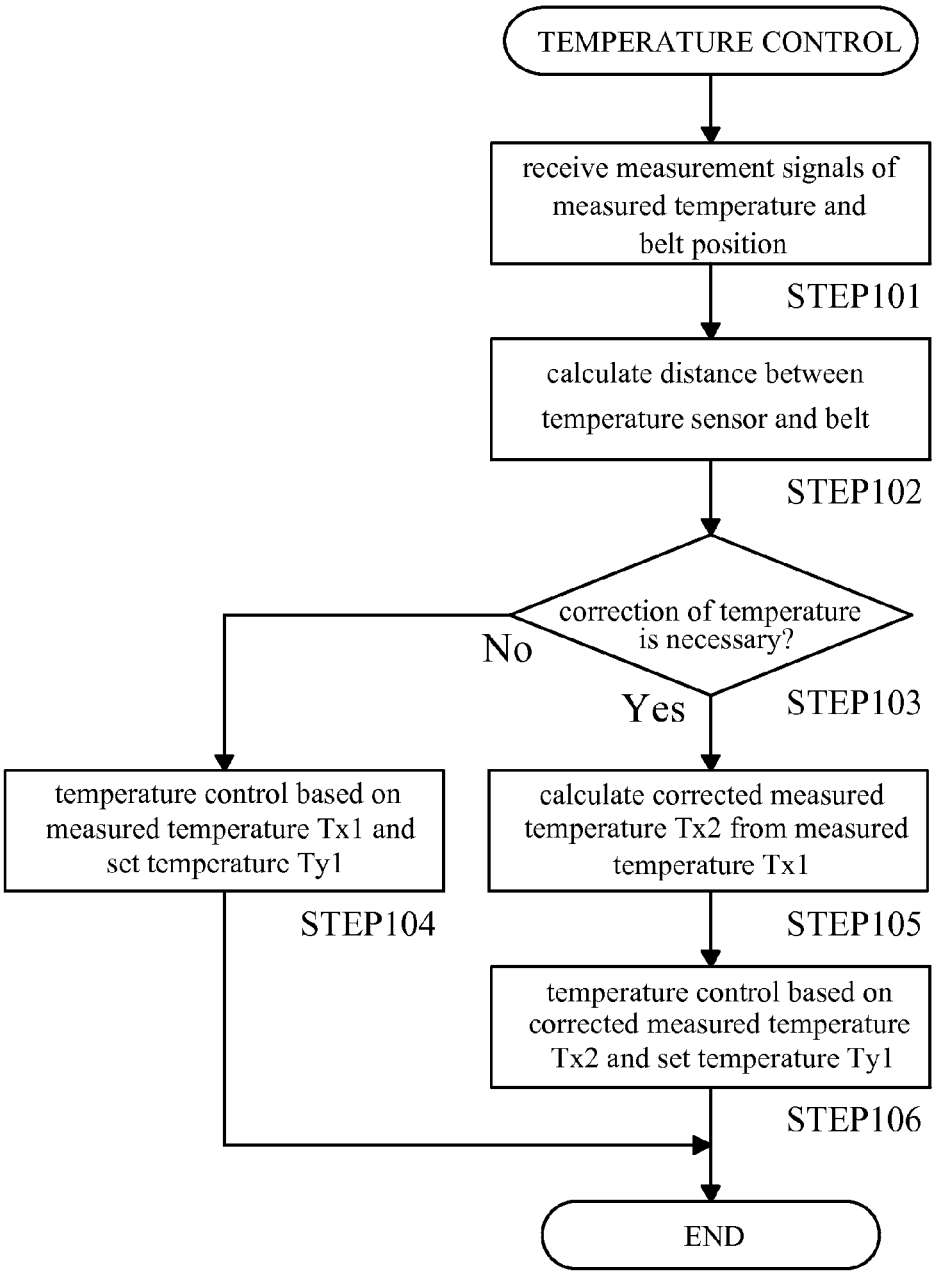
FIG. 13 is a flowchart showing a first example of a temperature control operation in the fixing device.

A first example of the temperature control operation of the fixing device 5 by the controller 28 is described below with reference to the flowchart of FIG. 13. In order to stabilize the surface temperature of the fixing belt 311 in the fixing device 5 at the set temperature, the controller 28 controls amount of heat generation of the heat source 318 on the basis of the comparison result between the temperature detected by the temperature sensor 40 and the set temperature. In other words, if the temperature detected by the temperature sensor 40 (measured temperature) is higher than the set temperature, the controller 28 controls the heat source 318 to decrease the amount of heat generation. If the temperature detected by the temperature sensor 40 is lower than the set temperature, the controller 28 controls the heat source 318 to increase the amount of heat generation. In this case, the controller 28 corrects the temperature detected by the temperature sensor 40 on the basis of position of the fixing belt 311 measured by the position detection sensor 41 and compares the corrected measured temperature with the set temperature.

When receiving measurement signals from the temperature sensor 40 and the position detection sensor 41 (STEP101), the controller 28 calculates the distance between the temperature sensor 40 and the fixing belt 311 on the basis of the measurement signal from the position detection sensor 41 (STEP102). Then, the controller 28 compares the distance calculated in STEP102 with the reference distance, and determines whether or not correction of a measured temperature Tx1 based on the measurement signal of the temperature sensor 41 is necessary (STEP103).

In STEP103, if the distance between the temperature sensor 40 and the fixing belt 311 is within a predetermined range with respect to the reference distance, the controller 28 determines that the correction of the measured temperature Tx1 is not necessary (No), and performs the temperature control of the heat source 318 on the basis of the comparison result between the measured temperature Tx1 and a set temperature Ty1 (STEP104). In other words, the controller 28 performs feedback control of the surface temperature of the fixing belt 311 to be the set temperature Ty1 on the basis of the measurement result by the temperature sensor 40.

In contrast, if the distance between the temperature sensor 40 and the fixing belt 311 (measured distance) is beyond the predetermined range with respect to the reference distance, the controller 28 determines that the correction of the measured temperature Tx1 is necessary (Yes in STEP103), and corrects the measured temperature Tx1 on the basis of the measured distance so as to calculate corrected measured temperature Tx2 (STEP105). Then, the controller 28 performs the temperature control of the heat source 318 on the basis of the comparison result between the corrected measured temperature Tx2 and the set temperature Ty1 (STEP106).

In STEP105, the controller 28 may calculate multiplier coefficient $\alpha 1$ on the basis of the comparison result between the measured distance and the reference distance, and may multiply the measured temperature Tx1 by the multiplier coefficient $\alpha 1$ so as to obtain the value $\alpha 1 \times$Tx1 as the corrected measured temperature Tx2. Alternatively, the controller 28 may calculate addition coefficient $\beta 1$ on the basis of the comparison result between the measured distance and the reference distance, and may add the addition coefficient $\beta 1$ to the measured temperature Tx1 so as to obtain the value Tx1+$\beta 1$ as the corrected measured temperature Tx2.

The multiplier coefficient $\alpha 1$ and the addition coefficient $\beta 1$ are set larger as the measured distance is longer. Further, the multiplier coefficient $\alpha 1$ is set to a value larger than one ($\alpha 1>1$) if the measured distance is longer than the reference distance and is set to a value smaller than one ($0<\alpha 1<1$) if the measured distance is shorter than the reference distance. In addition, the addition coefficient $\beta 1$ is set to a positive value ($\beta 1>0$) if the measured distance is longer than the reference distance and is set to a negative value ($\beta 1<0$) if the measured distance is shorter than the reference distance.

<Second Example of Temperature Control Operation>

Figure 14:
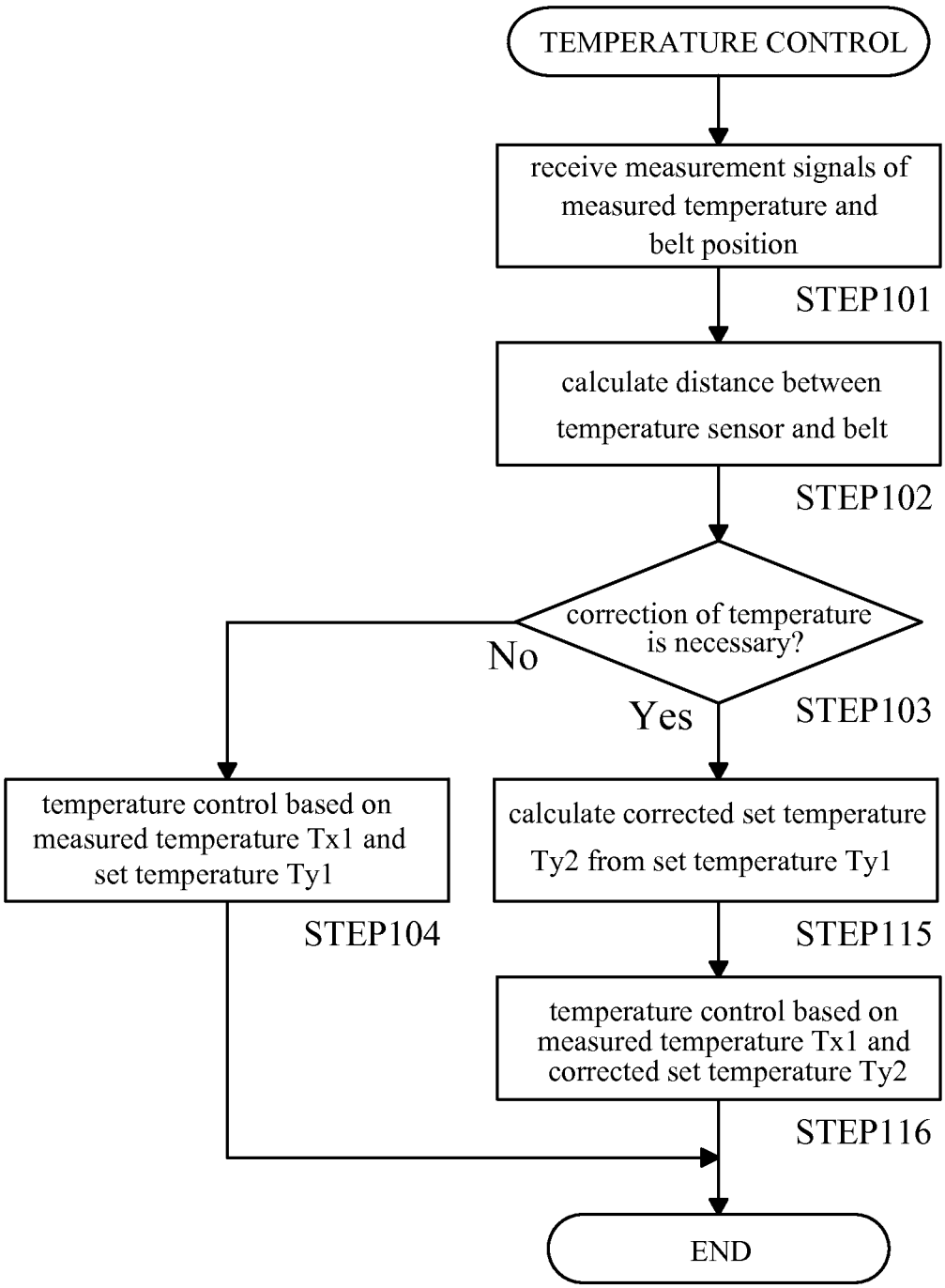
FIG. 14 is a flowchart showing a second example of the temperature control operation in the fixing device.

A second example of the temperature control operation of the fixing device 5 by the controller 28 is described below with reference to the flowchart of FIG. 14. In this example, unlike the first example described above, the controller 28 corrects the set temperature on the basis of the position of the fixing belt 311 measured by the position detection sensor 41 and compares the temperature detected by the temperature sensor 40 with the corrected set temperature, so as to control the amount of heat generation of the heat source 318 on the basis of the comparison result.

After receiving the measurement signals from the temperature sensor 40 and the position detection sensor 41 (STEP101), the controller 28 calculates the measured distance on the basis of the measurement signal from the position detection sensor 41 (STEP102) and determines whether or not the correction of the set temperature Ty1 is necessary (STEP103). When determining that the correction of the set temperature Ty1 is not necessary (No in STEP103), the controller 28 controls temperature of the heat source 318 on the basis of the comparison result between the measured temperature Tx1 and the set temperature Ty1 (STEP104).

On the contrary, when determining that the correction of the set temperature Ty1 is necessary (Yes in STEP103), the controller 28 corrects the measured temperature Ty1 on the basis of the measured distance and calculates corrected set temperature Ty2 (STEP115). Then, the controller 28 controls temperature of the heat source 318 on the basis of the comparison result between the measured temperature Tx1 and the corrected set temperature Ty2 (STEP116).

In STEP115, the controller 28 may calculate a multiplier coefficient $\alpha 2$ on the basis of the comparison result between the measured distance and the reference distance, and may multiply the set temperature Ty1 by the multiplier coefficient $\alpha 2$ so as to obtain the value $\alpha 2 \times$Ty1 as the corrected set temperature Ty2. Alternatively, the controller 28 may calculate an addition coefficient $\beta 2$ on the basis of the comparison result between the measured distance and the reference distance, and may add the addition coefficient $\beta 2$ to the set temperature Ty1 so as to the obtain value Ty1+$\beta 2$ as the corrected set temperature Ty2.

The multiplier coefficient $\alpha 2$ and the addition coefficient $\beta 2$ are set smaller as the measured distance is longer. Further, the multiplier coefficient $\alpha 2$ is set to a value smaller than one ($0<\alpha 2<1$) if the measured distance is longer than the reference distance and is set to a value larger than one ($\alpha 2>1$) if the measured distance is shorter than the reference distance. In addition, the addition coefficient $\beta 2$ is set to a negative value ($\beta 2<0$) if the measured distance is longer than the reference distance and is set to a positive value ($\beta 2>0$) if the measured distance is shorter than the reference distance.

If the measured distance becomes longer than the reference distance by 0.5 mm for example, when performing the first example of the temperature control operation described above, the controller 28 corrects the measured temperature Tx1 by the temperature sensor 40 to increase by 50% so as to calculate the corrected measured temperature Tx2. In contrast, when performing the second example of the temperature control operation described above, the controller 28 corrects the set temperature Ty1 to decrease by 3% so as to calculate the corrected measured temperature Ty2. The above-mentioned correction value of the measured temperature Tx1 or the set temperature Ty1 is merely an example and varies depending on a diameter of the fixing belt 311, a thickness of the belt, or a material of the belt.

In addition, as a displacement factor of the distance between the temperature sensor 40 and the fixing belt 311, there is not only the thermal deformation of the fixing belt 311 itself but also a displacement of a holding member (not shown, a resin component or a metal component) for holding the temperature sensor 40, or the like. Further, as a deformation factor of the holding member for the temperature sensor 40, there is heat applied to the fixing device 5 every time when the printing operation is performed, or the like, for example.

<Another Structural Example of Fixing Device>

Figure 15:
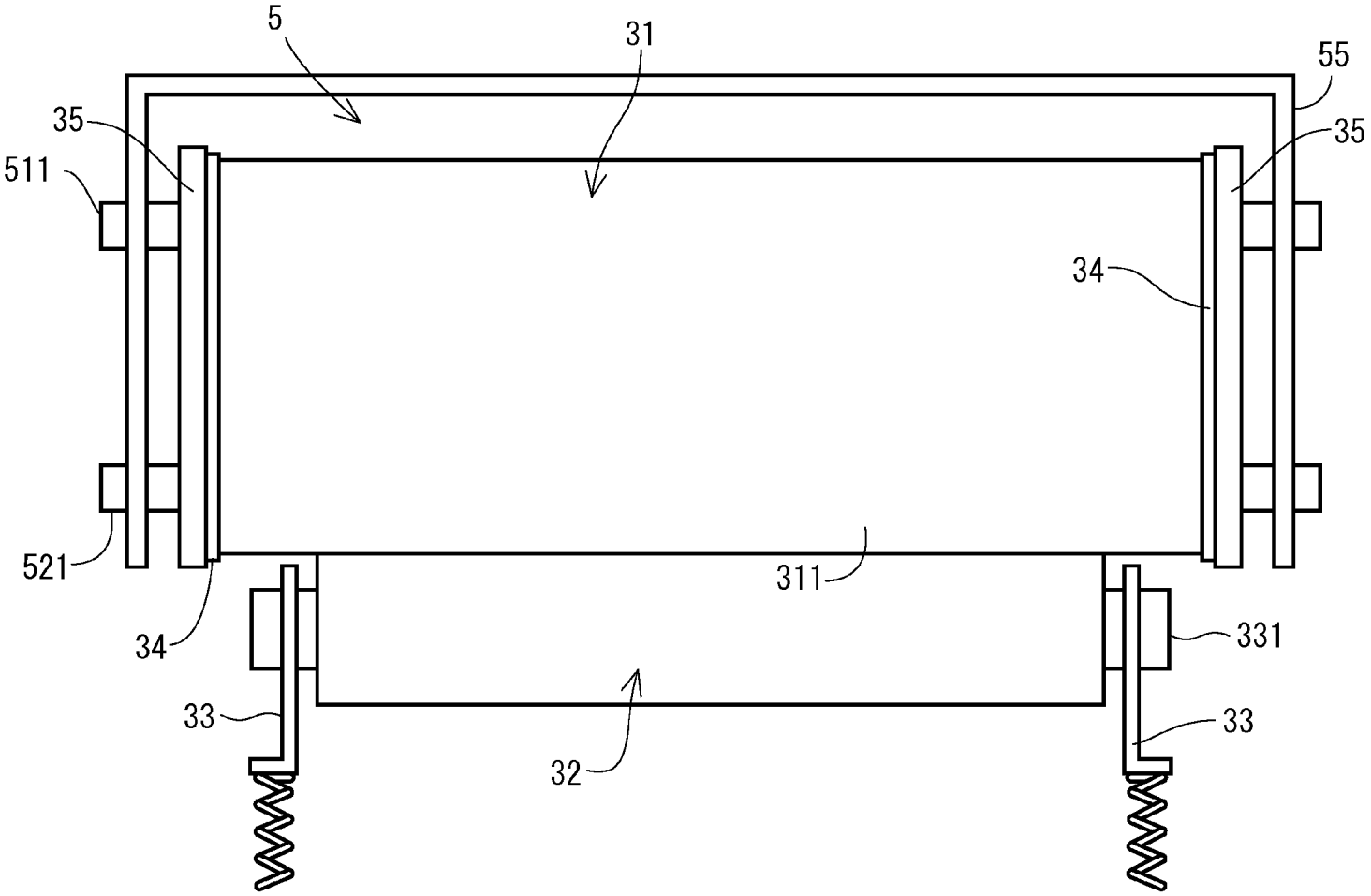
FIG. 15 is a schematic diagram showing another structural example of the fixing device.

Although the free belt type fixing device shown in FIGS. 2 to 4 is exemplified and described as the fixing device 5 in this embodiment, the fixing device 5 may be another type in which the fixing belt is stretched around a heating roller and the fixing roller. FIG. 15 is a plan view showing a structure of the fixing device of this example, and FIG. 16 is a cross-sectional view showing a structure of the fixing device of this example.

Figure 16:
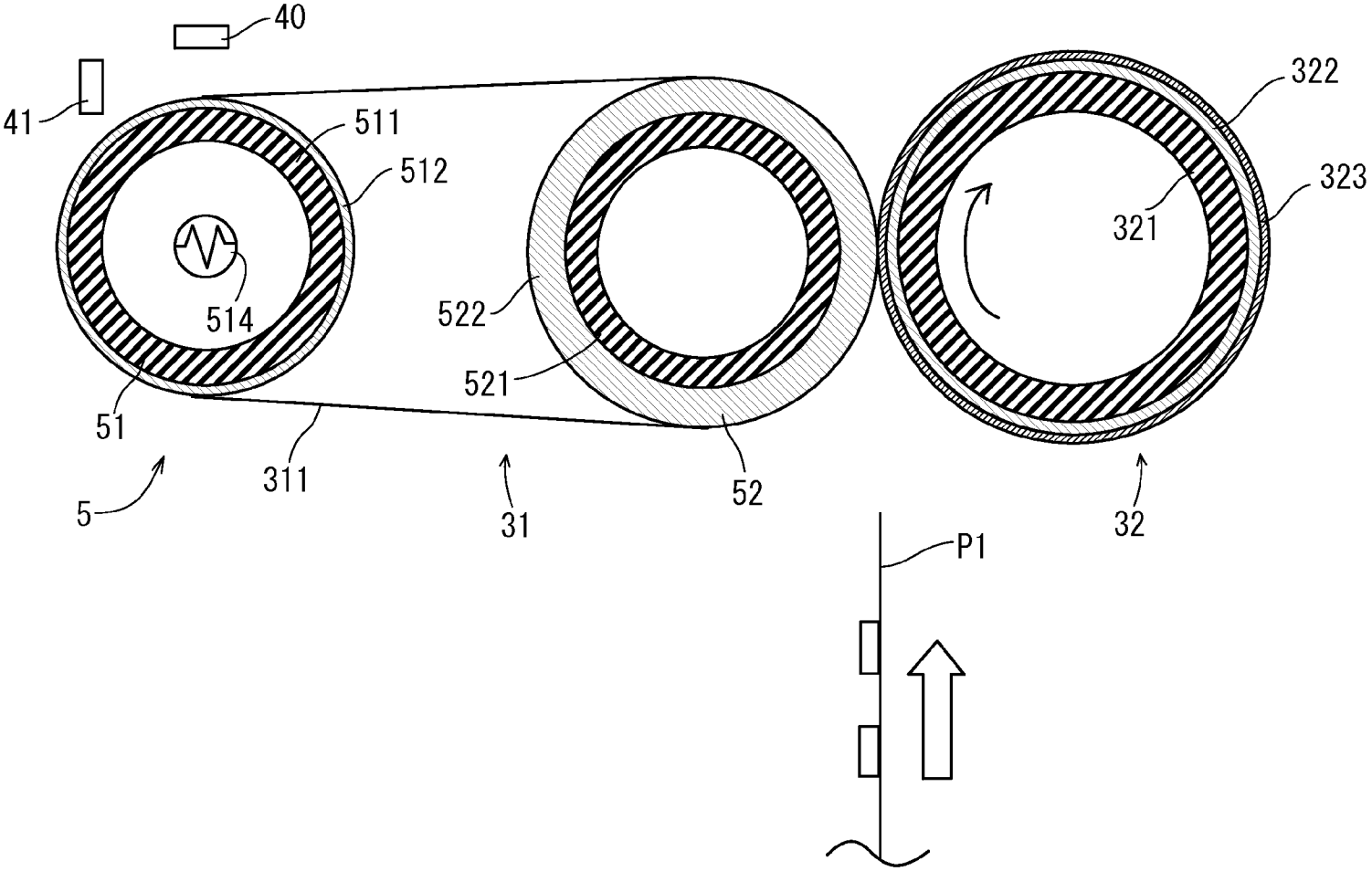
FIG. 16 is a schematic cross-sectional view showing an inside structure of the fixing device of FIG. 15.

As shown in FIGS. 15 and 16, the fixing device 5 of this example includes the heater 31 having a structure in which the fixing belt 311 is stretched around a heating roller 51 and a fixing roller 52, and a pressurizer 32 constituted of a press roller. In addition, the pressurizer 32 includes the core metal 321 pivoted by the roller support frame 33 and connected to the above-mentioned driving motor 39 so as to receive the driving force, and hence the pressurizer 32 is driven to rotate. In this case, the roller support frame 33 is biased and supported by a spring, the pressurizer 32 contacts to press the fixing belt 311.

Further, in the state where the fixing belt 311 is sandwiched between the pressurizer 32 and the fixing roller 52, the pressurizer 32 is pressed toward the fixing roller 52, so that the nip portion is formed between contact portions of the fixing belt 311 and the pressurizer 32. In addition, when the pressurizer 32 is driven to rotate, the fixing belt 311 and the fixing roller 52 follow and rotate. Further, while following to rotate, the entire circumference of the fixing belt 311 is heated by the heating roller 51 up to a predetermined temperature.

The heating roller 51 includes a core metal 511 inside which a heat source 514 such as a heater lamp is disposed, and a surface layer 512 having good heat resistance and wear resistance so as to cover the outer circumference surface of the core metal 511. The fixing roller 52 includes a core metal 521 pivoted by a roller support frame 55, and an elastic layer 522 having elasticity and heat resistance so as to cover the outer circumference surface of the core metal 521. The fixing belt 311 includes a base layer having heat resistance, strength, and surface smoothness, and an elastic layer covering the outer circumference surface of the base layer.

With these structures of the heater 31 and the pressurizer 32, after the fixing belt 311 is heated to a predetermined temperature, the recording sheet of paper P1 with an unfixed toner image enters the fixing nip portion. While the recording sheet of paper P1 is passing through the fixing nip portion formed between the fixing roller 52 with the fixing belt 311 and the pressurizer 32, the toner image is fixed onto the recording sheet of paper P1.

In this case, the temperature sensor 40 and the position detection sensor 41 are disposed at positions outside the fixing belt 311 in the outer periphery of the heating roller 51. In this way, the controller 28 can adjust temperature of the heat source 514 in the heating roller 51 in accordance with thermal deformation of the fixing belt 311, and hence can set the surface temperature of the fixing belt 311 to an optimal value. The temperature switching operation and the temperature control operation by the controller 28 can be performed by the control operation shown in each example described above.

As described above, according to this embodiment, because the temperature control of the fixing belt can be performed on the basis of the distance between the temperature detection section and the surface of the fixing belt measured by the position detection sensor, temperature of the fixing belt can be precisely adjusted. When the distance to the fixing belt is increased, abnormal heating in which the fixing belt is excessively heated can be prevented. As a result, not only power consumption but also emission of ultrafine particles can be reduced. On the contrary, when the distance to the fixing belt is decreased, insufficient heating of the fixing belt can be prevented. As a result, deterioration of fixing strength on the recording sheet of paper can be prevented. Further, because surface temperature of the fixing belt can be precisely controlled, thermal deformation of the fixing belt can be controlled and minimized.

Although the intermediate transfer type image forming apparatus is exemplified and described above as the image forming apparatus of the present invention, the image forming apparatus may be another type such as a direct transfer type or a rotary arrangement type including the fixing device described above. In addition, the image forming apparatus of the present invention may be a multifunction peripheral (MFP) having a copy function, a scanner function, a printer function, and a facsimile function, which includes the sheet feeding device and the paper feed mechanism of each embodiment described above, or may be a printer, a copying machine, a facsimile machine, or the like. Other than that, the structures of each section is not limited to the illustrated embodiment, but can be variously modified without deviating from the spirit of the present invention.

What is claimed is:

1. A fixing device comprising:

a pressurizer constituted of a rotating body;

a heater including a heat source, a fixing belt heated by the heat source, and a pressing portion disposed inside the fixing belt sandwiched between the pressing portion and the pressurizer disposed outside the fixing belt;

a non-contact type temperature detector for measuring a surface temperature of the fixing belt;

a displacement detector for detecting a displacement of a measurement target position of the fixing belt with respect to the temperature detector; and a controller configured to adjust an amount of heat generation of the heat source on the basis of the temperature detected by the temperature detector and the displacement detected by the displacement detector, so as to perform temperature adjustment of the surface temperature of the fixing belt, wherein:

a distance between the temperature detector and the measurement target position in a normal state with no displacement of the fixing belt is regarded as a reference distance, while a surface temperature of the fixing belt when performing the temperature adjustment at the reference distance is regarded as a reference temperature, and when the controller detects that the distance between the temperature detector and the measurement target position is shorter than the reference distance on the basis of the displacement detected by the displacement detector, the controller controls the temperature of the fixing belt to be higher than the reference temperature in the temperature control of the fixing belt based on the temperature detected by the temperature detector.

2. The fixing device according to claim 1, wherein when the controller detects that the fixing belt is in an expanded state on the basis of the displacement detected by the displacement detector, the controller controls the temperature of the fixing belt to be higher than the reference temperature.

3. A fixing device comprising:

a pressurizer constituted of a rotating body;

a heater including a heat source, a fixing belt heated by the heat source, and a pressing portion disposed inside the fixing belt sandwiched between the pressing portion and the pressurizer disposed outside the fixing belt;

a non-contact type temperature detector for measuring a surface temperature of the fixing belt;

a displacement detector for detecting a displacement of a measurement target position of the fixing belt with respect to the temperature detector; and a controller configured to adjust an amount of heat generation of the heat source on the basis of the temperature detected by the temperature detector and the displacement detected by the displacement detector, so as to perform temperature adjustment of the surface temperature of the fixing belt, wherein:

a distance between the temperature detector and the measurement target position in a normal state with no displacement of the fixing belt is regarded as a reference distance, while a surface temperature of the fixing belt when performing the temperature adjustment at the reference distance is regarded as a reference temperature, and when the controller detects that the distance between the temperature detector and the measurement target position is longer than the reference distance on the basis of the displacement detected by the displacement detector, the controller controls the temperature of the fixing belt to be lower than the reference temperature in the temperature control of the fixing belt based on the temperature detected by the temperature detector.

4. The fixing device according to claim 3, wherein when the controller detects that the fixing belt is in a contracted state on the basis of the displacement detected by the displacement detector, the controller controls the temperature of the fixing belt to be lower than the reference temperature.

5. The fixing device according to claim 1, wherein the controller compares a set temperature of the fixing belt with the surface temperature of the fixing belt detected by the temperature detector so as to perform the temperature control of the fixing belt, and corrects the surface temperature of the fixing belt detected by the temperature detector on the basis of the displacement detected by the displacement detector.

6. A fixing device comprising:

a pressurizer constituted of a rotating body;

a heater including a heat source, a fixing belt heated by the heat source, and a pressing portion disposed inside the fixing belt sandwiched between the pressing portion and the pressurizer disposed outside the fixing belt;

a non-contact type temperature detector for measuring a surface temperature of the fixing belt;

a displacement detector for detecting a displacement of a measurement target position of the fixing belt with respect to the temperature detector; and a controller configured to adjust an amount of heat generation of the heat source on the basis of the temperature detected by the temperature detector and the displacement detected by the displacement detector, so as to perform temperature adjustment of the surface temperature of the fixing belt, wherein the controller compares a set temperature of the fixing belt with the surface temperature of the fixing belt detected by the temperature detector so as to perform the temperature control of the fixing belt, and corrects the set temperature of the fixing belt on the basis of the displacement detected by the displacement detector.

7. The fixing device according to claim 1, wherein the controller performs the temperature control of the fixing belt by switching a set temperature of the fixing belt between a rotating state in which the fixing belt is rotating and a stop state in which the fixing belt is not rotating.

8. The fixing device according to claim 7, wherein the controller performs the temperature control of the fixing belt by switching the set temperature of the fixing belt depending on whether or not a recording sheet of paper is passing through a fixing nip portion between the pressurizer and the fixing belt in the rotating state.

9. The fixing device according to claim 1, wherein the heat source is disposed inside the fixing belt.

10. The fixing device according to claim 1, wherein the fixing belt is sandwiched and supported by guide members holding both edges of the fixing belt.

11. An image forming apparatus comprising the fixing device according to claim 1.

12. The fixing device according to claim 3, wherein the controller compares a set temperature of the fixing belt with the surface temperature of the fixing belt detected by the temperature detector so as to perform the temperature control of the fixing belt, and corrects the surface temperature of the fixing belt detected by the temperature detector on the basis of the displacement detected by the displacement detector.

13. The fixing device according to claim 3, wherein the controller performs the temperature control of the fixing belt by switching a set temperature of the fixing belt between a rotating state in which the fixing belt is rotating and a stop state in which the fixing belt is not rotating.

14. The fixing device according to claim 13, wherein the controller performs the temperature control of the fixing belt by switching the set temperature of the fixing belt depending on whether or not a recording sheet of paper is passing through a fixing nip portion between the pressurizer and the fixing belt in the rotating state.

15. The fixing device according to claim 3, wherein the heat source is disposed inside the fixing belt.

16. The fixing device according to claim 3, wherein the fixing belt is sandwiched and supported by guide members holding both edges of the fixing belt.

17. An image forming apparatus comprising the fixing device according to claim 3.

18. The fixing device according to claim 6, wherein the controller performs the temperature control of the fixing belt by switching the set temperature of the fixing belt between a rotating state in which the fixing belt is rotating and a stop state in which the fixing belt is not rotating.

19. The fixing device according to claim 18, wherein the controller performs the temperature control of the fixing belt by switching the set temperature of the fixing belt depending on whether or not a recording sheet of paper is passing through a fixing nip portion between the pressurizer and the fixing belt in the rotating state.

20. The fixing device according to claim 6, wherein the heat source is disposed inside the fixing belt.

* * * * *